US011661666B2

(12) United States Patent
Ijeri et al.

(10) Patent No.: US 11,661,666 B2
(45) Date of Patent: May 30, 2023

(54) ELECTRODEPOSITED ZINC AND IRON COATINGS FOR CORROSION RESISTANCE

(71) Applicant: THE BOEING COMPANY, Chicago, IL (US)

(72) Inventors: Vijaykumar S. Ijeri, Mumbai (IN); Stephen P. Gaydos, St. Louis, MO (US); Bidyut Kumar Manna, Kolkata (IN); Dibyendu Chakraborty, Kolkata (IN)

(73) Assignee: THE BOEING COMPANY, Arlington, VA (US)

( * ) Notice: Subject to any disclaimer, the term of this patent is extended or adjusted under 35 U.S.C. 154(b) by 0 days.

(21) Appl. No.: 16/598,306

(22) Filed: Oct. 10, 2019

(65) Prior Publication Data

US 2021/0108323 A1 Apr. 15, 2021

(51) Int. Cl.
*C25D 3/56* (2006.01)
*C25D 5/00* (2006.01)

(52) U.S. Cl.
CPC ..... *C25D 3/565* (2013.01); *C25D 3/562* (2013.01)

(58) Field of Classification Search
CPC ..... C25D 3/562; C25D 3/565; C25D 5/00
USPC ..... 205/244, 258, 259, 245
See application file for complete search history.

(56) References Cited

U.S. PATENT DOCUMENTS 3,642,591 A 2/1972 Boose et al.
3,664,933 A 5/1972 Clauss
3,833,486 A * 9/1974 Nobel ..... C25D 3/02 205/252
4,512,856 A 4/1985 Paneccasio
4,877,496 A 10/1989 Yanagawa et al.
(Continued)

FOREIGN PATENT DOCUMENTS

EP 2784189 A1 * 10/2014 ..... B32B 15/013
EP 3412799 A1 12/2018
WO 2017205473 A1 11/2017

OTHER PUBLICATIONS

Lan et al., "Electrodeposition of Zn—Fe Alloys Using Electrolytes of the System ZnO-(Ferrous Gluconate)-KOH," Journal of the Electrochemical Society (Nov. 22, 2006), vol. 154, No. 1, pp. D30-D33. (Year: 2006).*
(Continued)

*Primary Examiner* — Edna Wong
(74) *Attorney, Agent, or Firm* — Patterson + Sheridan, LLP

(57) ABSTRACT

Electrolyte solutions for electrodeposition of zinc alloys and methods of electrodepositing zinc-iron alloys. An electrolyte solution for electroplating can include an alkali metal hydroxide, a zinc salt, a condensation polymer of epichlorohydrin, a quaternary amine, an aliphatic amine, a polyhydroxy alcohol, an aromatic organic acid and/or salts thereof, an amino alcohol, a bisphosphonic acid and/or salts thereof, an iron salt, an alkali metal gluconate, and an amine-based chelating agent. Electrodepositing zinc alloys on a substrate can include introducing a cathode and an anode into an electrolyte solution comprising an alkali metal hydroxide, a zinc salt, a condensation polymer of epichlorohydrin, a quaternary amine, an aliphatic amine, a polyhydroxy alcohol, an aromatic organic acid and/or salts thereof, an amino alcohol, a bisphosphonic acid and/or salts thereof, an iron salt, an alkali metal gluconate, and an amine-based chelating agent.

26 Claims, 8 Drawing Sheets

(56) References Cited

U.S. PATENT DOCUMENTS

| | | | | |
|---|---|---|---|---|
| 4,889,602 | A | 12/1989 | Oshima et al. | |
| 4,923,575 | A | 5/1990 | Voss et al. | |
| 4,983,263 | A * | 1/1991 | Yasuda | C25D 3/565 205/245 |
| 5,194,140 | A | 3/1993 | Dobrovolskis et al. | |
| 2006/0283715 | A1 | 12/2006 | Diaddario et al. | |
| 2008/0223726 | A1* | 9/2008 | Eckles | C08G 73/02 205/305 |
| 2016/0024683 | A1* | 1/2016 | Dingwerth | C25D 17/002 205/244 |
| 2017/0022621 | A1* | 1/2017 | Niikura | C25D 3/565 |
| 2017/0314138 | A1 | 11/2017 | Hoshino et al. | |
| 2017/0314153 | A1 | 11/2017 | Ijeri et al. | |
| 2018/0195190 | A1 | 7/2018 | Trejo Cordova et al. | |
| 2018/0355497 | A1 | 12/2018 | Gaydos et al. | |
| 2020/0071843 | A1* | 3/2020 | Bokisa | C25D 5/48 |

OTHER PUBLICATIONS

Extended European Search Repost for Application No. 20200354.7-1103 dated May 3, 2021.

* cited by examiner

700

| Ratio of (Zn:Fe) | Initial | 72 hours | 144 hours | 216 hours |
|---|---|---|---|---|
| 95:5 |  710 |  712 |  714 |  716 |
| 90:10 |  720 |  722 |  724 |  726 |
| 85:15 |  730 |  732 |  734 |  736 |
| 80:20 |  740 |  742 |  744 |  746 |
| 75:25 |  750 |  752 |  754 |  756 |

ELECTRODEPOSITED ZINC AND IRON COATINGS FOR CORROSION RESISTANCE

FIELD

Aspects of the present disclosure provide electrolyte solutions for electrodeposition of zinc-iron alloys, methods of forming electrolyte solutions, and methods of electrodepositing zinc-iron alloys.

BACKGROUND

Development of corrosion resistant coatings is of commercial interest in, for example, the aerospace and automobile industries. Electroplated cadmium coatings have been used extensively as protective coatings in aggressive environments. Cadmium coatings provide excellent technical performance; however, cadmium presents health and environmental concerns and thus is heavily regulated. Cadmium is highly toxic in its metallic form as well as ionic form, and the cadmium plating baths typically contain cyanide. Thus, both the coating and the deposition process of cadmium are less preferred, and are the subject of strict environmental regulations.

Cadmium is a sacrificial coating, since its corrosion potential is more negative than that of steel. Thus, if the cadmium coating on a steel substrate is damaged the cadmium coating will corrode preferentially and protect the steel substrate. Several protective coatings have been developed as alternatives.

Aluminum coatings formed by ion vapor deposition is one alternative being considered. However, since ion vapor deposition is a line-of-sight process, it is difficult to coat complex geometries. Aluminum coatings formed by ion vapor deposition also require shot peening as a post coating operation to make the coating structure compact. Aluminum plating baths based on organic solvents are available. Although such aluminum coatings perform well, handling the organic solvents is less preferred.

Pure zinc coating is not suitable due to large difference in the electrochemical potentials of iron and zinc. Demands for higher quality finishes; more specifically, longer lasting finishes, have prompted a move to zinc alloy deposits. Zinc-nickel plating is another option as it provides good corrosion protection and has low hydrogen embrittlement. However, nickel is a suspected carcinogen and a skin allergen, hence is next on the list for restriction by Environmental bodies such as the European Chemicals Agency.

Zinc-iron (Zn—Fe) alloy, for example, has excellent corrosion resistance, good weldability, paintability, and formability. In addition, zinc-iron alloy coatings having high iron content serve as an effective undercoating for paints. Furthermore, the time for white rust formation of typical zinc-iron alloy coatings is often two to three times longer than that of a pure zinc metal coating.

Zinc-iron alloys can be deposited by electrodeposition. Electrodeposition of zinc-iron alloys often involves electrolyte solutions having cyanide, acid sulfates, ammonium chlorides and/or acid chlorides. However, electrodeposition using these electrolyte solutions tends to deposit zinc metal onto a substrate under plating conditions in much larger quantities as compared to iron deposition.

Therefore, there is a need in the art for improved electrolyte solutions for electrodeposition of zinc-iron alloys, methods of forming zinc-iron alloys, and methods of electrodepositing zinc-iron alloys.

SUMMARY

Aspects of the present disclosure provide electrolyte solutions for electrodeposition of zinc-iron alloys, methods of forming electrolyte solutions, and methods of electrodepositing zinc-iron alloys. In at least one aspect, a substrate comprising a zinc-iron alloy coating having a zinc content in a range of about 75 wt. % to about 95 wt. %, and an iron content in a range of about 5 wt. % to about 25 wt. %.

In at least one aspect, an electrolyte solution for electroplating is provided. The electrolyte solution comprises an alkali metal hydroxide, a zinc salt, a condensation polymer of epichlorohydrin, a quaternary amine, an aliphatic amine, a polyhydroxy alcohol, an aromatic organic acid and/or salts thereof, an amino alcohol, a bisphosphonic acid and/or salts thereof, an iron salt, an alkali metal gluconate, and an amine-based chelating agent.

In at least one aspect, an electrolyte solution for electroplating is provided. The electrolyte solution comprises an alkali metal hydroxide, a zinc salt, a condensation polymer of epichlorohydrin, a quaternary amine, an aliphatic amine, sorbitol, a benzoate, an amino alcohol, etidronic acid, an iron salt, an alkali metal gluconate, and N,N,N',N'-Tetrakis (2-Hydroxypropyl)ethylenediamine.

In at least one aspect, an electrolyte solution for electroplating is provided. The electrolyte solution comprises an alkali hydroxide in an amount ranging from about 1.0 mole per liter (mol/L) to about 5 mol/L of the electrolyte solution, a zinc salt in an amount ranging from about 0.1 moles per liter to about 0.2 moles per liter of the electrolyte solution, a condensation polymer of epichlorohydrin in an amount ranging from about 10 grams/liter to about 25 grams/liter of the electrolyte solution, a quaternary amine in an amount ranging from about 10 grams/L to about 30 grams/L, an aliphatic amine in an amount ranging from about 0.03 moles per liter to about 0.05 moles per liter, a polyhydroxy alcohol in an amount ranging from about 0.03 moles per liter to about 0.06 moles per liter, an aromatic organic acid and/or salts thereof in an amount ranging from about 0.002 moles per liter to about 0.008 moles per liter, an amino alcohol in an amount ranging from about 0.1 moles per liter to about 0.4 moles per liter, a bisphosphonic acid and/or salts thereof in an amount ranging from about 0.01 moles per liter to about 0.02 moles per liter, an iron salt in an amount ranging from about 0.05 moles per liter to about 0.1 moles per liter, an alkali metal gluconate in an amount ranging from about 0.05 moles per liter to about 0.12 moles per liter, and an amine-based chelating agent in an amount ranging from about 7 grams/liter to about 15 grams/liter.

In at least one aspect, an electrolyte solution for electroplating is provided. The electrolyte solution comprises an alkali hydroxide in an amount ranging from about 1.0 mole per liter (mol/L) to about 5 mol/L of the electrolyte solution, a zinc salt in an amount ranging from about 0.1 moles per liter to about 0.2 moles per liter of the electrolyte solution, a condensation polymer of epichlorohydrin in an amount ranging from about 10 grams/liter to about 25 grams/liter of the electrolyte solution, a quaternary amine in an amount ranging from about 10 grams/L to about 30 grams/L, an aliphatic amine in an amount ranging from about 0.03 moles per liter to about 0.05 moles per liter, sorbitol in an amount ranging from about 0.03 moles per liter to about 0.06 moles per liter, benzoate in an amount ranging from about 0.002 moles per liter to about 0.008 moles per liter, an amino alcohol in an amount ranging from about 0.1 moles per liter to about 0.4 moles per liter, etidronic acid in an amount ranging from about 0.01 moles per liter to about 0.02 moles per liter, an iron salt in an amount ranging from about 0.05 moles per liter to about 0.1 moles per liter, an alkali metal gluconate in an amount ranging from about 0.05 moles per liter to about 0.12 moles per liter, and N,N,N',N'-Tetrakis (2-Hydroxypropyl)ethylenediamine in an amount ranging from about 7 grams/liter to about 15 grams/liter.

In at least one aspect, a method of zinc plating on a substrate using an electrolyte solution is provided. The method comprises introducing a cathode and an anode into an electrolyte solution comprising an alkali hydroxide, a zinc salt, a condensation polymer of epichlorohydrin, a quaternary amine, an aliphatic amine, a polyhydroxy alcohol, an aromatic organic acid and/or salts thereof, an amino alcohol, a bisphosphonic acid and/or salts thereof, an iron salt, an alkali metal gluconate, and an amine-based chelating agent. The method further comprises passing a current between the anode and the cathode through the electrolyte to deposit a zinc-iron alloy layer on the substrate.

In at least one aspect, a method of zinc plating on a substrate using an electrolyte solution is provided. The method comprises introducing a cathode and an anode into an electrolyte solution comprising a zinc salt, an epichlorohydrin condensation product, a quaternary amine, an aliphatic amine, sorbitol, a benzoate, an amino alcohol, etidronic acid, an iron salt, an alkali metal gluconate, and N,N,N',N'-Tetrakis(2-Hydroxypropyl)ethylenediamine. The method further comprises passing a current between the anode and the cathode through the electrolyte to deposit a zinc-iron alloy layer on the substrate.

In at least one aspect, a method of zinc plating on a substrate using an electrolyte solution is provided. The method comprises dissolving in an aqueous medium an alkali hydroxide in an amount ranging from about 1.0 mole per liter (mol/L) to about 5 mol/L of the electrolyte solution, dissolving a zinc salt in an amount ranging from about 0.1 moles per liter to about 0.2 moles per liter of the electrolyte solution, dissolving a condensation polymer of epichlorohydrin in an amount ranging from about 10 grams/liter to about 25 grams/liter of the electrolyte solution, dissolving a quaternary amine in an amount ranging from about 10 grams/L to about 30 grams/L, dissolving an aliphatic amine in an amount ranging from about 0.03 moles per liter to about 0.05 moles per liter, dissolving a polyhydroxy alcohol in an amount ranging from about 0.03 moles per liter to about 0.06 moles per liter, dissolving an aromatic organic acid and/or salts thereof in an amount ranging from about 0.002 moles per liter to about 0.008 moles per liter, dissolving an amino alcohol in an amount ranging from about 0.1 moles per liter to about 0.4 moles per liter, dissolving a bisphosphonic acid and/or salts thereof in an amount ranging from about 0.01 moles per liter to about 0.02 moles per liter, dissolving an iron salt in an amount ranging from about 0.05 moles per liter to about 0.1 moles per liter, dissolving an alkali metal gluconate in an amount ranging from about 0.05 moles per liter to about 0.12 moles per liter, and dissolving an amine-based chelating agent in an amount ranging from about 7 grams/liter to about 15 grams/liter. The method further comprises passing a current between a cathode and an anode through the electrolyte solution to deposit a zinc-iron alloy on a substrate.

In at least one aspect, a method of zinc plating on a substrate using an electrolyte solution is provided. The method comprises dissolving in an aqueous medium an alkali hydroxide in an amount ranging from about 1.0 mole per liter (mol/L) to about 5 mol/L of the electrolyte solution, dissolving a zinc salt in an amount ranging from about 0.1 moles per liter to about 0.2 moles per liter of the electrolyte solution, dissolving an epichlorohydrin condensation product in an amount ranging from about 10 grams/liter to about 25 grams/liter of the electrolyte solution, dissolving a quaternary amine in an amount ranging from about 10 grams/L to about 30 grams/L, dissolving an aliphatic amine in an amount ranging from about 0.03 moles per liter to about 0.05 moles per liter, dissolving sorbitol in an amount ranging from about 0.03 moles per liter to about 0.06 moles per liter, dissolving benzoate in an amount ranging from about 0.002 moles per liter to about 0.008 moles per liter, dissolving an amino alcohol in an amount ranging from about 0.1 moles per liter to about 0.4 moles per liter, dissolving etidronic acid in an amount ranging from about 0.01 moles per liter to about 0.02 moles per liter, dissolving an iron salt in an amount ranging from about 0.05 moles per liter to about 0.1 moles per liter, dissolving an alkali metal gluconate in an amount ranging from about 0.05 moles per liter to about 0.12 moles per liter, and dissolving N,N,N',N'-Tetrakis(2-Hydroxypropyl)ethylenediamine in an amount ranging from about 7 grams/liter to about 15 grams/liter. The method further comprises passing a current between a cathode and an anode through the electrolyte solution to deposit a zinc-iron alloy on a substrate.

The features, functions, and advantages that have been discussed can be achieved independently in various aspects or may be combined in yet other aspects, further details of which can be seen with reference to the following description and drawings.

BRIEF DESCRIPTION OF DRAWINGS

So that the manner in which the above-recited features of the present disclosure can be understood in detail, a more particular description of the disclosure briefly summarized above may be had by reference to aspects, some of which are illustrated in the appended drawings. It is to be noted, however, that the appended drawings illustrate only typical aspects of this disclosure and are therefore not to be considered limiting of its scope, for the disclosure may admit to other equally effective aspects.

To facilitate understanding, identical reference numerals have been used, wherever possible, to designate identical elements that are common to the figures. Additionally, elements of one aspect may be advantageously adapted for utilization in other aspects described herein.

DETAILED DESCRIPTION

Figure 1A:
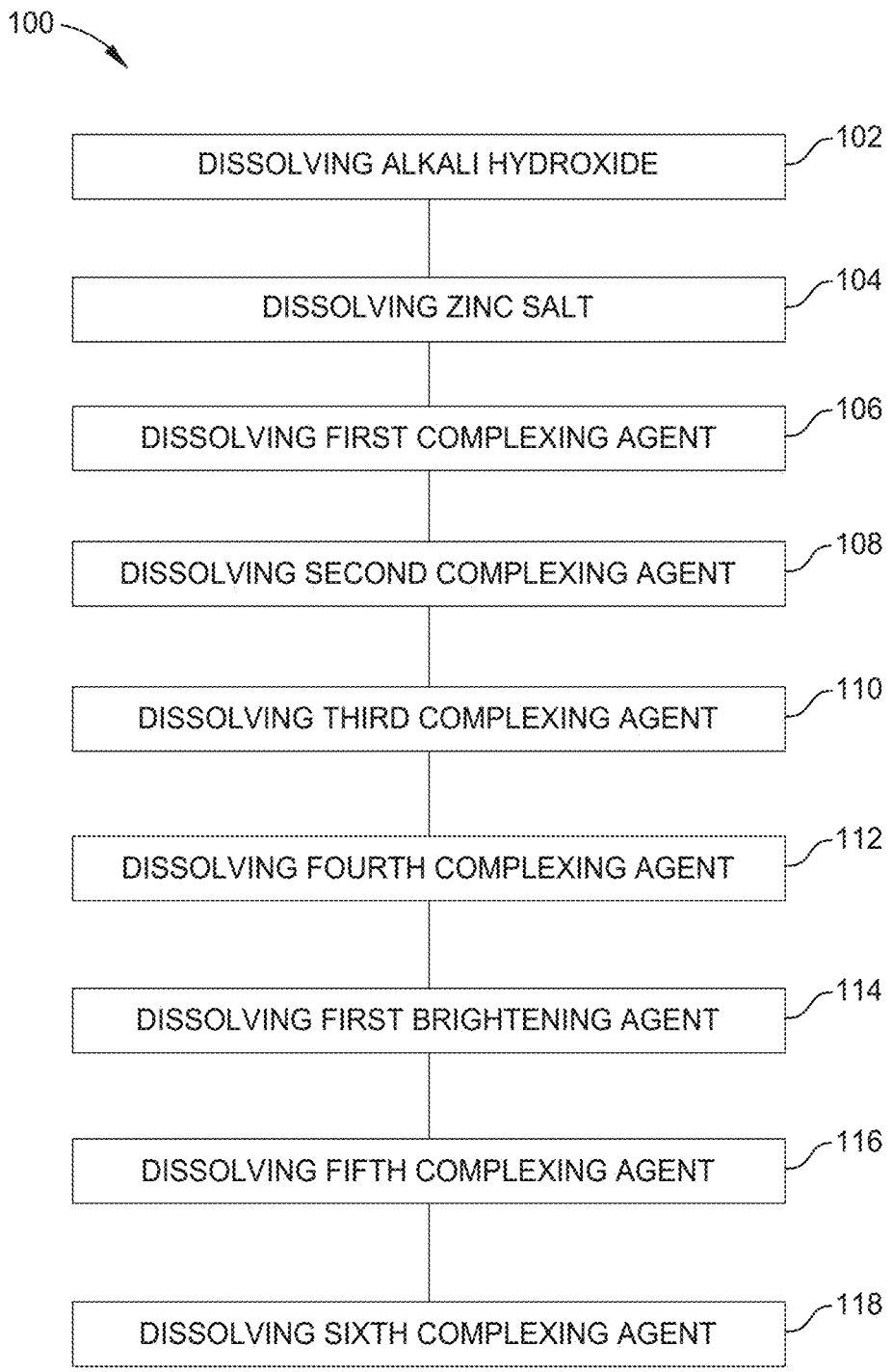
FIGS. 1A-1B depict a flow diagram illustrating a method for forming an electrolyte solution according to an aspect of the present disclosure.

The present disclosure provides various electrolyte compositions and methods for producing high corrosion resistant coatings on a substrate using direct current, while still resulting in a zinc-iron alloy layer (e.g., a zinc-iron alloy coating) formed on the substrate that is structurally robust and reliable, yet cost-effective. Zinc-iron alloys can be deposited by electrodeposition. Electrodeposition of zinc-iron alloys often involves electrolyte solutions having cyanide, acid sulfates, ammonium chlorides and/or acid chlorides. However, electrodeposition using these electrolyte solutions tends to deposit zinc metal onto a substrate under plating conditions in much larger quantities as compared to iron deposition. Commercially operated baths deposit less than 1% iron with zinc. This occurs because of formation of zinc hydroxide ($Zn(OH)_2$) which inhibits the deposition of iron onto the substrate. $Zn(OH)_2$ also adsorbs onto the cathode. Furthermore, complexing agents, such as ammonium chloride or amine-based compounds complex very strongly with iron salts in the electrolyte solution, which hinders iron metal deposition onto a substrate. Thus, formation of zinc alloys having high iron content is difficult to achieve and, accordingly, so are the beneficial properties of iron in a zinc-iron alloy.

In at least one aspect, the method comprises electrodeposition of a zinc and iron alloy coating from an aqueous alkaline plating solution containing zinc and iron in the form of soluble salts, complexing agents, buffers, and additives. The zinc-iron alloy coatings provide excellent corrosion protection and are amenable to conversion coatings on top of the zinc-iron alloy coatings for further enhancement of corrosion protection. In addition, since the zinc-iron alloy coatings are deposited from an alkaline bath, the chances of hydrogen embrittlement are greatly reduced since the tendency of hydrogen to form hydrogen ions and diffuse into steel substrates is reduced in alkaline media.

The present disclosure further provides electrolyte solutions for electrodeposition of zinc-iron alloys and methods of forming zinc-iron alloys. In at least one aspect, electrolyte solutions of the present disclosure are aqueous. In at least one aspect, the electrolyte solution is a borate-free system (e.g., does not include boric acid). In at least one aspect, the electrolyte solution is free from cadmium, cyanide, nickel, and boric acid. The electrolyte solution comprises an iron salt, such as, for example, ferrous sulfate or ferric chloride. It has been discovered that one or more of these iron salts present in an electrolyte solution provides deposition of zinc-iron alloy layers on a substrate, such as a steel substrate without the use of buffers such as boric acid. It is believed that alloying iron with zinc shifts the corrosion potential of the zinc-iron alloy coating towards more noble values and helps delay corrosion, as compared to pure zinc coatings.

Electrolyte solutions of the present disclosure provide controllable zinc-iron alloy deposition on a substrate. In at least one aspect controlling zinc-alloy deposition on a substrate is achieved by varying at least one of the ratio of zinc and iron ions and complexing agents in the electrolyte solution. In at least one aspect, the substrate is a steel substrate, copper substrate, brass substrate, copper-coated substrate, nickel-coated substrate, or other metal or metal alloy-containing substrate. In at least one aspect, the electrolyte solutions of the present disclosure when used at temperatures in a range of about 20° C. to about 40° C. at a pH greater than or equal to 12, for example, in a range of about 12 to about 14, such as about 14, provide satisfactorily corrosion resistant alloy deposits with low hydrogen embrittlement that are considered comparable to cadmium based electroplated coatings. It is believed that the alkaline pH of the electrolyte solution improves complexing and distribution of both zinc and iron in the zinc-iron alloy coatings. In at least one aspect, iron content of a zinc-iron alloy of the present disclosure is from about 5 wt. % iron to about 25 wt. % of iron based on the total weight of zinc and iron in the alloy.

Zinc-iron alloy coatings of the present disclosure provide improved corrosion resistance for substrates, such as high-strength steels as well as other steel substrates (for example, no red rust was observed after salt spray testing for 1000 hours or more) and pass a number of tests for use as coatings such as salt spray tests. The zinc-iron alloys of the present disclosure can be disposed on components of aircraft, spacecraft, watercraft, engine and blown-flap, exhaust-washed structures, warm-structure components for high-performance supersonic, hypersonic, and space re-entry vehicle structures, automobile parts, architectural structures such as steel bridges and propulsion structures such as power-generation turbines, vehicle engines, alternative-energy applications, and related technologies. As one specific example, alloys of the present disclosure can be disposed on steel-based landing gears and/or a bottom surface of an aircraft.

Zinc-iron coatings of the present disclosure are formed using a single bath technique. The deposition vessel is a glass beaker at a lab scale or large polypropylene tanks for plating on a commercial scale. The deposition vessel contains an electrolyte solution that is prepared by mixing all ingredients of the electrolyte solution concurrently or in a stepwise manner starting with zinc salts and complexing agents followed by iron salts. The anode (e.g., graphite, zinc, or mild steel) is introduced into the beaker containing electrolyte solution, as described in more detail below. The deposition process is modulated by applying direct current, which creates the zinc-iron alloy coating. The thickness of the zinc-iron alloy coating can be controlled by the duration of the direct current applied to the electrolyte solution electrodes. In at least one aspect, the total thickness of a zinc-iron alloy coating is from about 1 micron to about 30 microns, such as from about 5 microns to about 25 microns, such as from about 10 microns to about 20 microns, for example about 12 microns. In at least one aspect, the zinc-iron alloy coatings of the present disclosure have one or more passivation/conversion coatings disposed thereon. Such coatings include Hex-chrome or Tri-chrome based passivation/conversion coatings that are commercially available.

Varying the thickness and composition of a zinc-iron alloy coating can be controlled by current density and time scale of a deposition process of the present disclosure. For example, higher current density and/or time scale typically leads to increased thickness of the zinc-iron alloy coating.

An electrolyte solution is aqueous and comprises a metal salt. In at least one aspect, the metal salt includes a zinc salt and an iron salt. In at least one aspect, electrolyte solutions of the present disclosure further comprise at least one complexing agent selected from amines, hydroxyamines, and combinations thereof. Complexing agents such as tetrakis(2-Hydroxypropyl)ethylenediamine coordinate to iron ions in an electrolyte solution and promote controllable iron deposition on a substrate upon application of a current density to an electrolyte solution.

The pH of electrolyte solutions of the present disclosure is between about 12 and about 14, for example the pH is between about 13 and about 14, such as about 14. In at least one aspect, the pH of electrolyte solutions of the present disclosure are controlled by addition of one or more bases, such as a sodium hydroxide (NaOH) solution, to increase the pH of the solution or addition of one or more acids, such as a sulfuric acid ($H_2SO_4$) solution, to decrease the pH of the solution. Zinc salts, iron salts, complexing agents, buffering agents, acids, and bases can be obtained from any suitable commercial source, such as MERCK-India or Sigma-Aldrich Co. LLC of St. Louis, Mo. Additional additives such as conditioners, brighteners, and purifiers can be obtained from any suitable source, such as GTZ (India) Private Limited of India.

Electrodeposition can include preparing an electrolyte solution and passing current between an anode and a cathode in the electrolyte solution.

Figure 1B:
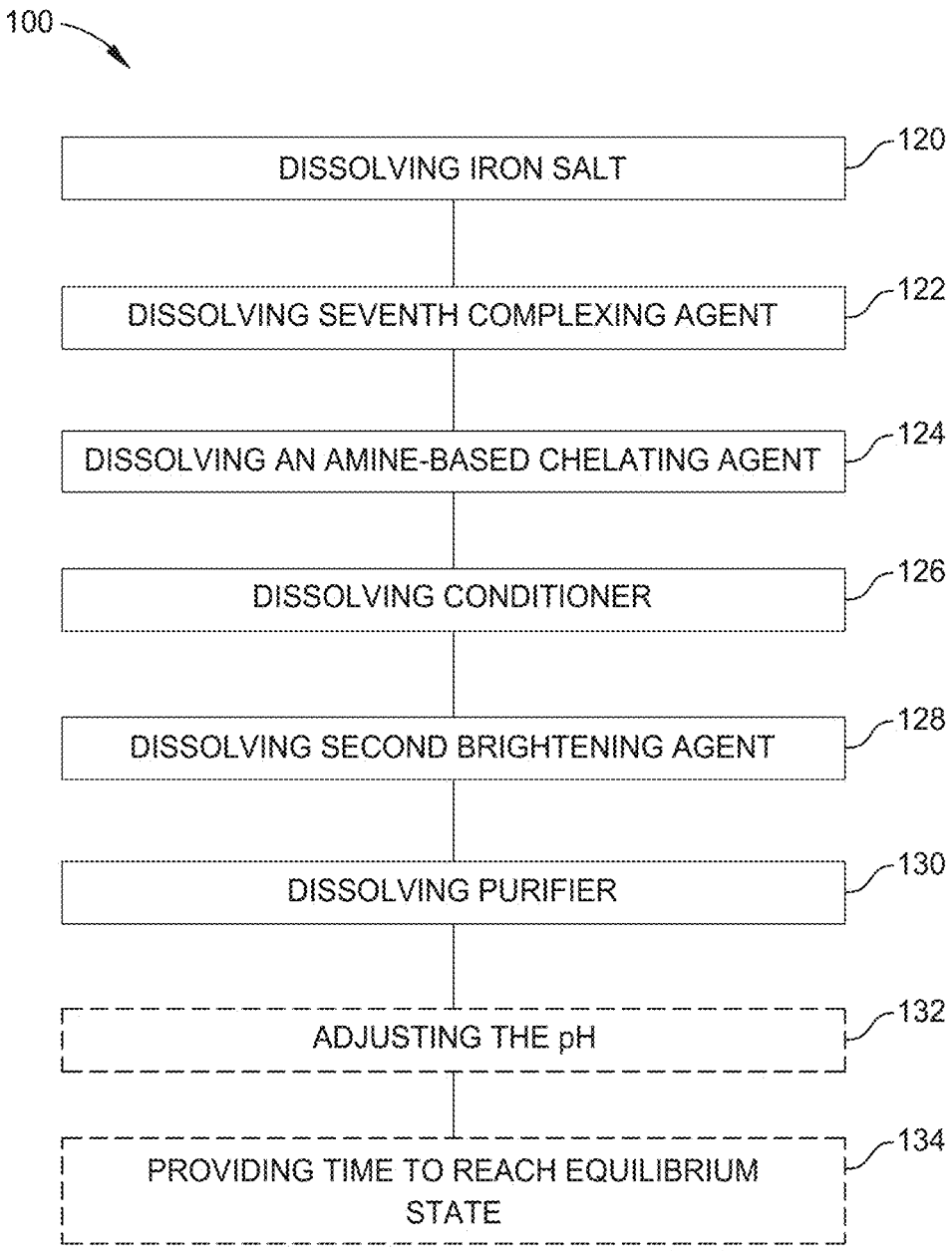

FIG. 1 is a flow diagram illustrating a method 100 for forming an electrolyte solution. As shown in FIG. 1, at operation 102, method 100 includes dissolving an alkali hydroxide in a medium such as water or an aqueous solution to form a first electrolyte solution. In at least one aspect, the alkali hydroxide includes sodium hydroxide, potassium hydroxide, or a combination thereof. In at least one aspect, the alkali hydroxide is sodium hydroxide. In at least one aspect, solid sodium hydroxide and/or solid potassium hydroxide is added to the medium. The alkali hydroxide maintains high alkalinity of the electrolyte solution while dissolving zinc oxide, which is an amphoteric oxide.

The concentration of the alkali hydroxide in the electrolyte of the present disclosure ranges from about 1.0 mole per liter (mol/L) to about 5 mol/L, such as in a range from about 2.0 mol/L to about 4.0 mol/L, such as in a range from about 2.0 mol/L to about 3.7 mol/L of the electrolyte solution, for example, in a range from about 2.0 mol/L to about 3.1 grams/L. In at least one aspect, the amount of the alkali hydroxide is about 1.0 mol/L, 1.5 mol/L, 2.0 mol/L, 2.5 mol/L, 3.0 mol/L, 3.1 mol/L, 3.5 mol/L, 4.0 mol/L, 4.5 mol/L, or 5.0 grams/L of the electrolyte solution, where any value may form an upper endpoint or a lower endpoint, as appropriate. At concentrations above 5 mol/L, it can become difficult to dissolve the alkali hydroxide in the electrolyte leading to solubility issues.

The alkali hydroxide is dissolved by stirring at ambient temperature, at room temperature, at about 25° C., or at a temperature ranging from about 10° C. to about 40° C., for example, from about 20° C. to about 30° C. The temperature at which operation 102 is performed can be about 10° C., 15° C., 20° C., 25° C., 30° C., 35° C., or 40° C., where any value may form an upper endpoint or a lower endpoint, as appropriate. The stirring can be performed for about 5 minutes, 10 minutes, 15 minutes, 20 minutes, 25 minutes, or 30 minutes, where any value may form an upper endpoint or a lower endpoint, as appropriate, or until all the alkali hydroxide has been dissolved.

At operation 104, the method 100 further includes dissolving a zinc salt, for example, in water or an aqueous solution (such as the first solution) to form an electrolyte solution, such as a second electrolyte solution. The zinc salt functions as a source of zinc ions to the electrolyte solution. The zinc salt can be zinc oxide or a divalent zinc salt. In at least one aspect, a divalent zinc salt is zinc (II) sulfate, zinc (II) chloride, zinc (II) acetate, and/or other divalent zinc salt. In at least one aspect, each of the divalent zinc salts includes its respective hydrated forms. For example, zinc (II) sulfate has the formula $ZnSO_4.xH_2O$, where x is a whole number (e.g., 0, 1, 2, 4, 5, 6, or 7). Accordingly, in at least one aspect, zinc (II) sulfate is anhydrous zinc (II) sulfate, zinc (II) sulfate monohydrate, zinc (II) sulfate dihydrate, zinc (II) sulfate tetrahydrate, zinc (II) sulfate pentahydrate, zinc (II) sulfate hexahydrate, zinc (II) sulfate heptahydrate, or zinc (II) sulfate with another hydration state. Alternatively, zinc (II) chloride is anhydrous zinc (II) chloride, zinc (II) chloride monohydrate, zinc (II) chloride dihydrate, zinc (II) chloride tetrahydrate, zinc (II) chloride pentahydrate, zinc (II) chloride hexahydrate, zinc (II) chloride heptahydrate, or zinc (II) chloride with another hydration state.

The concentration of the zinc salt in the electrolyte of the present disclosure ranges from about 0.05 moles per liter (mol/L) to about 0.4 mol/L, such as in a range from about 0.1 mol/L to about 0.3 mol/L of the electrolyte solution, for example, in a range from about 0.1 mol/L to about 0.2 mol/L. In at least one aspect, the amount of the zinc salt that is dissolved is about 0.05 mol/L, 0.1 mol/L, 0.12 mol/L, 0.2 mol/L, 0.3 mol/L, or 0.4 mol/L of the electrolyte solution, where any value may form an upper endpoint or a lower endpoint, as appropriate. Low zinc salt concentrations such as concentrations from about 0.05 mol/L to about 0.4 mol/L help reduce drag out losses. In addition, zinc salt concentrations above 0.4 mol/L may result in non-uniform deposition across varying current densities.

The zinc salt is dissolved, for example, by stirring at a temperature from about 20° C. to about 30° C., such as about 25° C. The stirring can be performed for from about 5 minutes to about 60 minutes, such as from about 10 minutes to about 50 minutes, such as from about 20 minutes to about 40 minutes or until substantially all of the zinc salt has been dissolved.

At operation 106, the method 100 further includes dissolving a first complexing agent, for example, in water or an aqueous solution (such as the second electrolyte solution) to form an electrolyte solution (e.g., a third electrolyte solution). The first complexing agent aids in the uniform distribution of metal deposits, grain refining, and brightness. The first complexing agent is a condensation polymer of epichlorohydrin. Since the condensation polymer of epichlorohydrin is a condensation polymer with amine containing moieties, the condensation polymer of epichlorohydrin can form complexes with both zinc ions and iron ions. Examples of the complexing agent include polyamine compounds including polyepoxy-polyamines such as a condensation polymer of ethylenediamine with epichlorohydrin, a condensation polymer of dimethylaminopropylamine with epichlorohydrin, a condensation polymer of imidazole with epichlorohydrin, condensation polymers of imidazole derivatives such as 1-methylimidazole and 2-methylimidazole with epichlorohydrin, and condensation polymers of heterocyclic amine including triazine derivatives such as acetoguanamine and benzoguanamine and the like with epichlorohydrin; polyamide-polyamines including polyamine-polyurea resins such as a condensation polymer of 3-dimethylaminopropylurea with epichlorohydrin and a condensation polymer of bis(N,N-dimethylaminopropyl)urea with epichlorohydrin and water-soluble nylon resins such as condensation polymers of N,N-dimethylaminopropylamine, an alkylenedicarboxylic acid, and epichlorohydrin, and the like. In at least one aspect, the epichlorohydrin condensation polymer is an imidazole-epichlorohydrin condensation polymer, an amine-formaldehyde-epichlorohydrin condensation polymer, or a combination thereof. Non-limiting examples of a suitable imidazole-epichlorohydrin condensation polymer is commercially available from GTZ (India) Private Limited of India under the tradename MSP such as MSP-IMZE.

The concentration of the first complexing agent in the electrolyte of the present disclosure ranges from about 1 gram per liter (gram/L) to about 30 gram/L, such as in a range from about 10 grams/L to about 30 grams/L, such as in a range from about 10 grams/L to about 20 grams/L of the electrolyte solution, for example, in a range from about 15 grams/L to about 18 grams/L, such as about 18 grams/L. In at least one aspect, the amount of the first complexing agent that is dissolved is about 1 gram/L, 5 gram/L, 10 gram/L, 15 grams/L, 18 grams/L, 20 grams/L, 25 grams/L, or 30 grams/L of the electrolyte solution, where any value may form an upper endpoint or a lower endpoint, as appropriate.

The first complexing agent is dissolved by stirring at ambient temperature, at room temperature, at about 25° C., or at a temperature ranging from about 10° C. to about 40° C., for example, from about 20° C. to about 30° C. In at least one aspect, the temperature at which operation 106 is performed can be about 10° C., 15° C., 20° C., 25° C., 30° C., 35° C., or 40° C., where any value may form an upper endpoint or a lower endpoint, as appropriate. The stirring can be performed for about 5 minutes, 10 minutes, 15 minutes, 20 minutes, 25 minutes, or 30 minutes, where any value may form an upper endpoint or a lower endpoint, as appropriate, or until all the first complexing agent has been dissolved.

At operation 108, the method 100 further includes dissolving a second complexing agent, for example, in water or an aqueous solution (such as the third electrolyte solution) to form an electrolyte solution (e.g., a fourth electrolyte solution). The second complexing agent aids in the uniform distribution of metal deposits, grain refining, and brightness. The second complexing agent is a nitrogen-containing heterocyclic quaternary ammonia salt. In at least one aspect, the second complexing agent is an aqueous solution of a nitrogen-containing heterocyclic quaternary ammonia salt. In at least one aspect, the nitrogen-containing heterocyclic quaternary ammonium salt complexing agent is a carboxy group- and/or hydroxy group-substituted nitrogen-containing heterocyclic quaternary ammonium salt. Examples of the nitrogen-containing heterocycle of the nitrogen-containing heterocyclic quaternary ammonium salt include a pyridine ring, a piperidine ring, an imidazole ring, an imidazoline ring, a pyrrolidine ring, a pyrazole ring, a quinoline ring, a morpholine ring, and the like. In the quaternary ammonium salt compound, the carboxy group and/or the hydroxy group can be introduced onto the nitrogen-containing heterocycle as a substituent through another substituent as in the case of, for example, a carboxymethyl group. Moreover, the nitrogen-containing heterocycle may have substituents such as alkyl groups, in addition to the carboxy group and/or the hydroxy group. In addition, unless an effect achieved by the complexing agent contained is impaired, the N substituents forming the heterocyclic quaternary ammonium cation are not particularly limited, and examples thereof include substituted or non-substituted alkyl, aryl, or alkoxy groups, and the like. In addition, examples of the counter anion forming the salt include halogen anions, oxyanions, borate anions, sulfonate anion, phosphate anions, imide anion, and the like, and the counter anion is preferably a halogen anion. Examples of the nitrogen-containing heterocyclic quaternary ammonium salt compound include N-benzyl-3-carboxypyridinium chloride, N-phenethyl-4-carboxypyridinium chloride, N-butyl-3-carboxypyridinium bromide, N-chloromethyl-3-carboxypyridinium bromide, N-hexyl-6-hydroxy-3-carboxypyridinium chloride, N-hexyl-6-3-hydroxypropyl-3-carboxypyridinium chloride, N-2-hydroxyethyl-6-methoxy-3-carboxypyridinium chloride, N-methoxy-6-methyl-3-carboxypyridinium chloride, N-propyl-2-methyl-6-phenyl-3-carboxypyridinium chloride, N-propyl-2-methyl-6-phenyl-3-carboxypyridinium chloride, N-benzyl-3-carboxymethylpyridinium chloride, 1-butyl-3-methyl-4-carboxyimidazolium bromide, 1-butyl-3-methyl-4-carboxymethylimidazolium bromide, 1-butyl-2-hydroxymethyl-3-methylimidazolium chloride, 1-butyl-1-methyl-3-methylcarboxypyrrolidinium chloride, 1-butyl-1-methyl-4-methylcarboxypiperidinium chloride, and the like. In at least one aspect, the second complexing agent is an alkyl amine ammonium polymer. Non-limiting examples of a suitable nitrogen-containing heterocyclic quaternary ammonia salt are commercially available from GTZ (India) Private Limited of India under the tradename MSP such as MSP-PQ2

The concentration of the second complexing agent in the electrolyte of the present disclosure ranges from about 1 gram per liter (gram/L) to about 30 gram/L, such as in a range from about 10 grams/L to about 30 grams/L, such as in a range from about 10 grams/L to about 20 grams/L of the electrolyte solution, for example, in a range from about 15 grams/L to about grams/L. In at least one aspect, the amount of the second complexing agent that is dissolved is about 1 gram/L, 5 grams/L, 10 grams/L, 15 grams/L, 18 grams/L, 20 grams/L, 25 grams/L, or 30 grams/L of the electrolyte solution, where any value may form an upper endpoint or a lower endpoint, as appropriate.

The second complexing agent is dissolved by stirring at ambient temperature, at room temperature, at about 25° C., or at a temperature ranging from about 10° C. to about 40° C., for example, from about 20° C. to about 30° C. The temperature at which operation 108 is performed can be about 10° C., 15° C., 20° C., 25° C., 30° C., 35° C., or 40° C., where any value may form an upper endpoint or a lower endpoint, as appropriate. The stirring can be performed for about 5 minutes, 10 minutes, 15 minutes, 20 minutes, 25 minutes, or 30 minutes, where any value may form an upper endpoint or a lower endpoint, as appropriate, or until all the second complexing agent has been dissolved.

At operation 110, the method 100 further includes dissolving a third complexing agent for example, in water or an aqueous solution (such as the fourth electrolyte solution) to form an electrolyte solution (e.g., a fifth electrolyte solution). In at least one aspect, the third complexing agent is an aliphatic amine. The aliphatic amine can form complexes with both zinc ions and iron ions. Examples of the aliphatic amine include ethylenediamine, diethylenetriamine, dipropylenetriamine, triethylenetetramine, tetraethylenepentamine, hexamethylenediamine, and N,N'-bis-(triaminopropyl) ethylenediamine, or a combination thereof. In at least one aspect, the third complexing agent is diethylenetriamine.

The concentration of the third complexing agent in the electrolyte of the present disclosure ranges from about 0.001 mol/L to about 1.0 mol/L, such as in a range from about 0.01 mol/L to about 0.07 mol/L, such as in a range from about 0.01 mol/L to about 0.05 mol/L of the electrolyte solution, for example, in a range from about 0.03 mol/L to about 0.05 mol/L. In at least one aspect, the amount of the third complexing agent that is dissolved is about 0.01 mol/L, 0.02 mol/L, 0.03 mol/L, 0.035 mol/L, 0.04 mol/L, 0.05 mol/L, 0.06 mol/L, 0.07 mol/L, 0.08 mol/L, or 0.09 mol/L of the electrolyte solution, where any value may form an upper endpoint or a lower endpoint, as appropriate.

The third complexing agent is dissolved by stirring at ambient temperature, at room temperature, at about 25° C., or at a temperature ranging from about 20° C. to about 30° C. The stirring can be performed for about 5 minutes, 10 minutes, 15 minutes, 20 minutes, 25 minutes, or 30 minutes, where any value may form an upper endpoint or a lower endpoint, as appropriate, or until all the third complexing agent has been dissolved. The temperature at which operation 110 is performed can be about 10° C., 15° C., 20° C., 25° C., 30° C., 35° C., or 40° C., where any value may form an upper endpoint or a lower endpoint, as appropriate.

At operation 112, the method 100 further includes dissolving a fourth complexing agent for example, in water or an aqueous solution (such as the fifth electrolyte solution) to form an electrolyte solution (e.g., a sixth electrolyte solution). In at least one aspect, the fourth complexing agent is a polyhydroxy alcohol. The polyhydroxy alcohol can form complexes with both zinc ions and iron ions. Examples of the polyhydroxy alcohol include ethylene glycol, propylene glycol, glycerin, B-methyl glycerin, erythritol, diglycerol, polyglycerols, sugar alcohols such as mannitol and sorbitol, sugar acids, reaction products of the polyhydroxy alcohols with ethylene oxide and other poly-hydroxy compounds. In at least one aspect, the fourth complexing agent is sorbitol.

The concentration of the fourth complexing agent in the electrolyte of the present disclosure ranges from about 0.001 mol/L to about 1.0 mol/L, such as in a range from about 0.01 mol/L to about 0.07 mol/L, such as in a range from about 0.03 mol/L to about 0.06 mol/L of the electrolyte solution, for example, in a range from about 0.04 mol/L to about 0.05 mol/L. In at least one aspect, the amount of the fourth complexing agent that is dissolved is about 0.01 mol/L, 0.02 mol/L, 0.03 mol/L, 0.04 mol/L, 0.046 mol/L, 0.05 mol/L, 0.06 mol/L, 0.07 mol/L, 0.08 mol/L, or 0.09 mol/L of the electrolyte solution, where any value may form an upper endpoint or a lower endpoint, as appropriate.

The fourth complexing agent is dissolved by stirring at ambient temperature, at room temperature, at about 25° C., or at a temperature ranging from about 20° C. to about 30° C. The stirring can be performed for about 5 minutes, 10 minutes, 15 minutes, 20 minutes, 25 minutes, or 30 minutes, where any value may form an upper endpoint or a lower endpoint, as appropriate, or until all the fourth complexing agent has been dissolved. The temperature at which operation 112 is performed can be about 10° C., 15° C., 20° C., 25° C., 30° C., 35° C., or 40° C., where any value may form an upper endpoint or a lower endpoint, as appropriate.

At operation 114, the method 100 further includes dissolving a first brightening agent for example, in water or an aqueous solution (such as the fifth electrolyte solution) to form an electrolyte solution (e.g., a sixth electrolyte solution). In at least one aspect, the first brightening agent is an aromatic organic acid and/or salts thereof. In at least one aspect, the aromatic organic acid and/or salts thereof is a benzoate. Examples of the benzoate include sodium benzoate, potassium benzoate, or a combination thereof. In at least one aspect, the aromatic organic acid and/or salt thereof is sodium benzoate. In at least one aspect, the aromatic organic acid or its salt functions as a brightener. The absence of the aromatic organic acid and/or salt thereof in deposition baths causes a loss of brightness in deposits and the formation of a dark layer on the anode due to the accumulation of oxidation products.

The concentration of the first brightening agent in the electrolyte of the present disclosure ranges from about 0.001 mol/L to about 0.01 mol/L, such as in a range from about 0.001 mol/L to about 0.009 mol/L, such as in a range from about 0.002 mol/L to about 0.008 mol/L of the electrolyte solution, for example, in a range from about 0.004 mol/L to about 0.005 mol/L. In at least one aspect, the amount of the first brightening agent that is dissolved is about 0.001 mol/L, 0.002 mol/L, 0.003 mol/L, 0.004 mol/L, 0.0046 mol/L, 0.005 mol/L, 0.006 mol/L, 0.007 mol/L, 0.008 mol/L, 0.009 mol/L, or 0.01 mol/L of the electrolyte solution, where any value may form an upper endpoint or a lower endpoint, as appropriate. At concentrations above 0.01 mol/L, the first brightening agent can lead to the formation of patchy zinc-iron alloy deposits.

The first brightening agent is dissolved by stirring at ambient temperature, at room temperature, at about 25° C., or at a temperature ranging from about 20° C. to about 30° C. The stirring can be performed for about 5 minutes, 10 minutes, 15 minutes, 20 minutes, 25 minutes, or 30 minutes, where any value may form an upper endpoint or a lower endpoint, as appropriate, or until all of the first brightening agent has been dissolved. The temperature at which operation 114 is performed can be about 10° C., 15° C., 20° C., 25° C., 30° C., 35° C., or 40° C., where any value may form an upper endpoint or a lower endpoint, as appropriate.

At operation 116, the method 100 further includes dissolving a fifth complexing agent for example, in water or an aqueous solution (such as the sixth electrolyte solution) to form an electrolyte solution (e.g., a seventh electrolyte solution). In at least one aspect, the fifth complexing agent is an amino alcohol compound. Examples of the amino alcohol compound include ethanolamine, diethanolamine, triethanolamine, or a combination thereof. In at least one aspect, the amino alcohol is triethanolamine. In at least one aspect, the fifth complexing agent functions as a carrier of zinc and iron ions and improves the process, rendering it capable of producing good deposits with less careful control of the current density being required.

The concentration of the fifth complexing agent in the electrolyte of the present disclosure ranges from about 0.10 mol/L to about 1.0 mol/L, such as in a range from about 0.10 mol/L to about 0.70 mol/L, such as in a range from about 0.10 mol/L to about 0.40 mol/L of the electrolyte solution, for example, in a range from about 0.20 mol/L to about 0.30 mol/L. In at least one aspect, the amount of the fifth complexing agent that is dissolved is about 0.1 mol/L, 0.2 mol/L, 0.24 mol/L, 0.3 mol/L, 0.4 mol/L, 0.5 mol/L, 0.6 mol/L, 0.7 mol/L, 0.8 mol/L, or 0.9 mol/L of the electrolyte solution, where any value may form an upper endpoint or a lower endpoint, as appropriate. At concentrations above 1.0 mol/L, the fifth complexing agent can hinder deposition of zinc and iron.

The fifth complexing agent is dissolved by stirring at ambient temperature, at room temperature, at about 25° C., or at a temperature ranging from about 20° C. to about 30° C. The stirring can be performed for about 5 minutes, 10 minutes, 15 minutes, 20 minutes, 25 minutes, or 30 minutes, where any value may form an upper endpoint or a lower endpoint, as appropriate, or until all the fifth complexing agent has been dissolved. The temperature at which operation 116 is performed can be about 10° C., 15° C., 20° C., 25° C., 30° C., 35° C., or 40° C., where any value may form an upper endpoint or a lower endpoint, as appropriate.

At operation 118, the method 100 further includes dissolving a sixth complexing agent for example, in water or an aqueous solution (such as the eighth electrolyte solution) to form an electrolyte solution (e.g., a ninth electrolyte solution). In at least one aspect, the sixth complexing agent is a bisphosphonic acid or its salt. Examples of the bisphosphonic acid or its salt include etidronic acid, etidronate, hydrates thereof, or a combination thereof. In at least one aspect, the sixth complexing agent functions as a zinc-chelating agent. In at least one aspect, the sixth complexing agent is etidronic acid.

The concentration of the sixth complexing agent in the electrolyte of the present disclosure ranges from about 0.001 mol/L to about 0.05 mol/L, such as in a range from about 0.01 mol/L to about 0.05 mol/L, such as in a range from about 0.01 mol/L to about 0.04 mol/L of the electrolyte solution, for example, in a range from about 0.01 mol/L to about 0.02 mol/L. In at least one aspect, the amount of the sixth complexing agent that is dissolved is about 0.01 mol/L, 0.012 mol/L, 0.02 mol/L, 0.03 mol/L, 0.035 mol/L, 0.04 mol/L, or 0.05 mol/L of the electrolyte solution, where any value may form an upper endpoint or a lower endpoint, as appropriate. At concentrations above 0.05 mol/L, the sixth complexing agent can hinder deposition of zinc and iron.

The sixth complexing agent is dissolved by stirring at ambient temperature, at room temperature, at about 25° C., or at a temperature ranging from about 20° C. to about 30° C. The stirring can be performed for about 5 minutes, 10 minutes, 15 minutes, 20 minutes, 25 minutes, or 30 minutes, where any value may form an upper endpoint or a lower endpoint, as appropriate, or until all the sixth complexing agent has been dissolved. The temperature at which operation 118 is performed can be about 10° C., 15° C., 20° C., 25° C., 30° C., 35° C., or 40° C., where any value may form an upper endpoint or a lower endpoint, as appropriate.

At operation 120, the method 100 further includes dissolving an iron salt for example, in water or an aqueous solution (such as the ninth electrolyte solution) to form an electrolyte solution (e.g., a tenth electrolyte solution). In at least one aspect, the iron salt is a divalent iron salt, a trivalent iron salt, or a combination thereof. In at least one aspect, the iron salt is ferrous sulfate heptahydrate, ferric chloride, or a combination thereof. In at least one aspect, the iron salt is a divalent iron salt. Examples of the divalent iron salts include iron (II) sulfate, iron (II) chloride, iron (II) acetate, and/or other divalent iron salts. Each of these divalent iron salts can include its respective hydrated forms. For example, iron (II) sulfate has the formula $FeSO_4.xH_2O$, where x is a whole number (e.g., 0, 1, 2, 4, 5, 6, or 7). Accordingly, in at least one aspect, iron (II) sulfate is anhydrous iron (II) sulfate, iron (II) sulfate monohydrate, iron (II) sulfate dihydrate, iron (II) sulfate tetrahydrate, iron (II) sulfate pentahydrate, iron (II) sulfate hexahydrate, iron (II) sulfate heptahydrate, or iron (II) sulfate with another hydration state. In at least one aspect, the iron salt is a trivalent iron salt. Examples of the trivalent iron salts include iron (III) sulfate, iron (III) chloride, iron (III) acetate, and/or other trivalent iron salts. Each of these trivalent iron salts can include its respective hydrated forms. For example, iron (III) sulfate has the formula $Fe_2(SO_4)_3{\cdot}xH_2O$, where x is a whole number (e.g., 0, 1, 2, 4, 5, 6, or 7). Accordingly, in at least one aspect, iron (III) sulfate is anhydrous iron (III) sulfate, iron (III) sulfate monohydrate, iron (III) sulfate dihydrate, iron (III) sulfate tetrahydrate, iron (III) sulfate pentahydrate, iron (III) sulfate hexahydrate, iron (III) sulfate heptahydrate, or iron (III) sulfate with another hydration state. In a further example, iron (III) chloride has the formula $FeCl_3.xH_2O$, where x is a whole number (e.g., 0, 1, 2, 4, 5, 6, or 7). Accordingly, in at least one aspect, iron (III) chloride is anhydrous iron (III) chloride, iron (III) chloride monohydrate, iron (III) chloride dihydrate, iron (III) chloride tetrahydrate, iron (III) chloride pentahydrate, iron (III) chloride hexahydrate, iron (III) chloride heptahydrate, or iron (III) chloride with another hydration state.

The iron salt in the electrolyte of the present disclosure ranges from about 0.001 mol/L to about 0.5 mol/L, such as in a range from about 0.01 mol/L to about 0.3 mol/L, such as in a range from about 0.01 mol/L to about 0.2 mol/L of the electrolyte solution, for example, in a range from about 0.05 mol/L to about 0.1 mol/L. In at least one aspect, the amount of the iron salt that is dissolved is about 0.001 mol/L, 0.05 mol/L, 0.07 mol/L, 0.1 mol/L, 0.2 mol/L, 0.3 mol/L, 0.4 mol/L, or 0.5 mol/L of the electrolyte solution, where any value may form an upper endpoint or a lower endpoint, as appropriate.

The iron salt is dissolved by stirring at ambient temperature, at room temperature, at about 25° C., or at a temperature ranging from about 20° C. to about 30° C. The stirring can be performed for about 5 minutes, 10 minutes, 15 minutes, 20 minutes, 25 minutes, or 30 minutes, where any value may form an upper endpoint or a lower endpoint, as appropriate, or until all the iron salt has been dissolved. The temperature at which operation 120 is performed can be about 10° C., 15° C., 20° C., 25° C., 30° C., 35° C., or 40° C., where any value may form an upper endpoint or a lower endpoint, as appropriate.

At operation 122, the method 100 further includes dissolving a seventh complexing agent for example, in water or an aqueous solution (such as the tenth electrolyte solution) to form an electrolyte solution (e.g., an eleventh electrolyte solution). In at least one aspect, the seventh complexing agent functions as a complexing agent, which forms complexes with iron. In at least one aspect, the seventh complexing agent is a gluconate-based complexing agent. In at least one aspect, the seventh complexing agent is an alkali metal gluconate. Examples of the alkali metal gluconate include sodium gluconate, potassium gluconate, or a combination thereof.

The concentration of the seventh complexing agent in the electrolyte of the present disclosure ranges from about 0.001 mol/L to about 0.3 mol/L, such as in a range from about 0.01 mol/L to about 0.3 mol/L, such as in a range from about 0.01 mol/L to about 0.2 mol/L of the electrolyte solution, for example, in a range from about 0.05 mol/L to about 0.12 mol/L. In at least one aspect, the amount of the seventh complexing agent that is dissolved is about 0.001 mol/L, 0.05 mol/L, 0.07 mol/L, 0.09 mol/L, 0.12 mol/L, 0.2 mol/L, or 0.3 mol/L of the electrolyte solution, where any value may form an upper endpoint or a lower endpoint, as appropriate. At concentrations above 0.3 mol/L, the seventh complexing agent can hinder deposition of zinc and iron.

The seventh complexing agent is dissolved by stirring at ambient temperature, at room temperature, at about 25° C., or at a temperature ranging from about 20° C. to about 30° C. The stirring can be performed for about 5 minutes, 10 minutes, 15 minutes, 20 minutes, 25 minutes, or 30 minutes, where any value may form an upper endpoint or a lower endpoint, as appropriate, or until all the seventh complexing agent has been dissolved. The temperature at which operation 122 can be performed is about 10° C., 15° C., 20° C., 25° C., 30° C., 35° C., or 40° C., where any value may form an upper endpoint or a lower endpoint, as appropriate.

At operation 124, the method 100 further includes dissolving an amine-based chelating agent for example, in water or an aqueous solution (such as the eleventh electrolyte solution) to form an electrolyte solution (e.g., a twelfth electrolyte solution). The amine-based complexing agent is a strong complexing agent for iron. Examples of the amine-based chelating agent include alkyleneamine compounds such as ethylenediamine, triethylenetetramine, and tetraethylenepentamine; ethylene oxide or propylene oxide adducts of the above-described alkyleneamines; amino alcohols such as N-(2-aminoethyl)ethanolamine and 2-hydroxyethylaminopropylamine; poly(hydroxyalkyl)alkylenediamines such as N-2(-hydroxyethyl)-N,N',N'-triethylethylenediamine, N,N'-di(2-hydroxyethyl)-N,N'-diethylethylenediamine, N,N,N',N'-tetrakis(2-hydroxyethyl)propylenediamine, and N,N,N',N'-tetrakis(2-hydroxypropyl)ethylenediamine; poly (alkyleneimines) obtained from ethyleneimine, 1,2-propyleneimine, and the like; poly(alkyleneamines) and poly (amino alcohols) obtained from ethylenediamine, triethylenetetramine, ethanolamine, diethanolamine, or a combination thereof. In at least one aspect, the amine-based complexing agent is N,N,N',N'-Tetrakis(2-Hydroxypropyl) ethylenediamine. Amine-based complexing agents such as N,N,N',N'-Tetrakis(2-Hydroxypropyl)ethylenediamine are commercially available from BASF Corp. of Florham Park, N.J. under the trade name Lutropur® Q75.

The concentration of the amine-based complexing agent in the electrolyte of the present disclosure ranges from about 1 gram per liter (gram/L) to about 20 gram/L, such as in a range from about 5 grams/L to about 20 grams/L, such as in a range from about 7 grams/L to about 15 grams/L of the electrolyte solution, for example, in a range from about 10 grams/L to about 12 grams/L. In at least one aspect, the amount of the amine-based complexing agent that is dissolved is about 1 gram/L, 5 grams/L, 7 grams/L, 10 grams/L, 12 grams/L, 15 grams/L, 18 grams/L, or 20 grams/L of the electrolyte solution, where any value may form an upper endpoint or a lower endpoint, as appropriate. At concentrations above 20 grams/L, the amine-based complexing agent can hinder deposition of zinc and iron.

The amine-based complexing agent is dissolved by stirring at ambient temperature, at room temperature, at about 25° C., or at a temperature ranging from about 20° C. to about 30° C. The stirring can be performed for about 5 minutes, 10 minutes, 15 minutes, 20 minutes, 25 minutes, or 30 minutes, where any value may form an upper endpoint or a lower endpoint, as appropriate, or until all the amine-based complexing agent has been dissolved. The temperature at which operation 124 can be performed is about 10° C., 15° C., 20° C., 25° C., 30° C., 35° C., or 40° C., where any value may form an upper endpoint or a lower endpoint, as appropriate.

In at least one aspect, the components of operations 120, 122, and 124 are mixed together prior to adding the components to an aqueous solution (such as the ninth electrolyte solution) to form an electrolyte solution (e.g., a tenth electrolyte solution). The gluconate-based complexing agent is a weak complexing agent for iron and the amine-based complexing agent is a strong complexing agent for iron. It is beneficial to mix the iron salt with the gluconate and amine-based chelating agents before adding the iron salt to the highly alkaline zinc solution.

At operation 126, the method 100 further includes dissolving a conditioner for example, in water or an aqueous solution (such as the twelfth electrolyte solution) to form an electrolyte solution (e.g., a thirteenth electrolyte solution). The conditioner masks the impacts of hard water on the electrolyte solution. Non-limiting examples of a suitable conditioner are commercially available from GTZ (India) Private Limited of India under the tradename ULTRABRITE such as ULTRABRITE 617.

The concentration of the conditioner in the electrolyte of the present disclosure ranges from about 1 milliliter per liter (ml/L) to about 30 ml/L, such as in a range from about 10 ml/L to about 30 ml/L, such as in a range from about 10 ml/L to about 20 ml/L of the electrolyte solution, for example, in a range from about 15 ml/L to about ml/L. In at least one aspect, the amount of the conditioner that is dissolved is about 1 ml/L, 5 ml/L, 10 ml/L, 15 ml/L, 18 ml/L, 20 ml/L, 25 ml/L, or 30 ml/L of the electrolyte solution, where any value may form an upper endpoint or a lower endpoint, as appropriate. At concentrations above 30 ml/L, the conditioner may become ineffective or even deleterious to the electrolyte solution.

The conditioner is dissolved by stirring at ambient temperature, at room temperature, at about 25° C., or at a temperature ranging from about 20° C. to about 30° C. The stirring can be performed for about 5 minutes, 10 minutes, 15 minutes, 20 minutes, 25 minutes, or 30 minutes, where any value may form an upper endpoint or a lower endpoint, as appropriate, or until all the conditioner has been dissolved. The temperature at which operation 126 can be performed is about 10° C., 15° C., 20° C., 25° C., 30° C., 35° C., or 40° C., where any value may form an upper endpoint or a lower endpoint, as appropriate.

At operation 128, the method 100 further includes dissolving a second brightening agent for example, in water or an aqueous solution (such as the thirteenth electrolyte solution) to form an electrolyte solution (e.g., a fourteenth electrolyte solution). Non-limiting examples of a suitable brightening agents are commercially available from GTZ (India) Private Limited of India under the tradename ULTRABRITE such as ULTRABRITE 617B.

The concentration of the second brightening agent in the electrolyte of the present disclosure ranges from about 0.10 milliliters per liter (ml/L) to about 10 ml/L, such as in a range from about 0.10 ml/L to about 3 ml/L, such as in a range from about 0.10 ml/L to about 1 ml/L of the electrolyte solution, for example, in a range from about 1 ml/L to about 2 ml/L. In at least one aspect, the amount of the second brightening agent that is dissolved is about 0.1 ml/L, 0.3 ml/L, 0.5 ml/L, 0.8 ml/L, 1 ml/L, 0.1.2 ml/L, 1.5 ml/L, 2.0 ml/L, or 3.0 ml/L of the electrolyte solution, where any value may form an upper endpoint or a lower endpoint, as appropriate. At concentrations above 10.0 ml/L, the first brightening agent can lead to the formation of patchy zinc-iron alloy deposits.

The second brightening agent is dissolved by stirring at ambient temperature, at room temperature, at about 25° C., or at a temperature ranging from about 20° C. to about 30° C. The stirring can be performed for about 5 minutes, 10 minutes, 15 minutes, 20 minutes, 25 minutes, or 30 minutes, where any value may form an upper endpoint or a lower endpoint, as appropriate, or until all the brightener has been dissolved. The temperature at which operation 126 can be performed is about 10° C., 15° C., 20° C., 25° C., 30° C., 35° C., or 40° C., where any value may form an upper endpoint or a lower endpoint, as appropriate.

At operation 130, the method 100 further includes dissolving a purifier for example, in water or an aqueous solution (such as the fourteenth electrolyte solution) to form an electrolyte solution (e.g., a fifteenth electrolyte solution). The purifier masks the impacts of hard water on the electrolyte solution. Non-limiting examples of a suitable purifiers are commercially available from GTZ (India) Private Limited of India under the tradename ULTRABRITE such as ULTRABRITE 617P.

The concentration of the purifier in the electrolyte of the present disclosure ranges from about 0.1 milliliters per liter (ml/L) to about 10 ml/L, such as in a range from about 0.10 ml/L to about 3 ml/L, such as in a range from about 0.10 ml/L to about 1 ml/L of the electrolyte solution, for example, in a range from about 1 ml/L to about 2 ml/L. In at least one aspect, the amount of the purifier that is dissolved is about 0.01 ml/L, 0.1 ml/L, 0.3 ml/L, 0.5 ml/L, 0.8 ml/L, 1 ml/L, 0.1.2 ml/L, 1.5 ml/L, 2.0 ml/L, or 3.0 ml/L of the electrolyte solution, where any value may form an upper endpoint or a lower endpoint, as appropriate. At concentrations above 10 ml/L, the purifier may become ineffective or even deleterious to the electrolyte solution.

The purifier is dissolved by stirring at ambient temperature, at room temperature, at about 25° C., or at a temperature ranging from about 20° C. to about 30° C. The stirring can be performed for about 5 minutes, 10 minutes, 15 minutes, 20 minutes, 25 minutes, or 30 minutes, where any value may form an upper endpoint or a lower endpoint, as appropriate, or until all the purifier has been dissolved. The temperature at which operation 130 is performed can be about 10° C., 15° C., 20° C., 25° C., 30° C., 35° C., or 40° C., where any value may form an upper endpoint or a lower endpoint, as appropriate.

In at least on aspect, at operation 132 the method 100 further includes adjusting the pH of the electrolyte solution using one or more aqueous acid solutions or aqueous base solutions, such as potassium hydroxide (KOH), sodium hydroxide (NaOH), and/or sulfuric acid ($H_2SO_4$). The volume of aqueous acid solution or aqueous base solution added to the electrolyte solution is sufficiently small such that the concentration of other components (complexing agents, buffering agents, etc.) of the electrolyte solution is not substantially affected. Alternatively, solid potassium hydroxide and/or solid sodium hydroxide is added directly to the electrolyte solution and/or concentrated sulfuric acid is added directly to the electrolyte solution. In at least one aspect, the pH of the electrolyte solution is adjusted to a target pH greater than or equal to 12, such as from about 12 to about 14, such as from about 13 to about 14, for example 13, 13.5, or 14. In at least one aspect, the pH of an electrolyte solution of the present disclosure is adjusted before passing a current through the electrolyte solution (as described in more detail below). In at least one aspect, the pH of an electrolyte solution of the present disclosure is maintained at a target pH or a target pH range during the passing of a current through the electrolyte solution.

In at least one aspect, at operation 134, time is provided to reach equilibrium state. In at least one aspect, the solution is left to stand for a time ranging from 1 hour to 2 days to reach the equilibrium state. The time provided to reach the equilibrium state can be about 1 hour, 3 hours, 6 hours, 9 hours, 12 hours, 15 hours, 18 hours, 21 hours, 24 hours, 27 hours, 30 hours, 33 hours, 36 hours, 39 hours, 42 hours, 45 hours, or 48 hours, where any value may form an upper endpoint or a lower endpoint, as appropriate.

In at least one aspect, the method 100 is performed in the order presented. In at least one aspect, the method 100 is performed in a different order. Some operations can be performed in order while other operations are performed in a different order. For example, operations 102 and 104 are performed in order, while operations 106, 108, 110, 112, 114, 116, 118, 120, 122, 124, 126, 128, and 130 are performed in a different order after operations 102 and 104. In another example, operations 102 and operations 104 are performed in a different order while operations 106, 108, 110, 112, 114, 116, 118, 120, 122, 124, 126, 128, and 130 are performed in order. In another example, operations 102, 104, 106, 108, 110, 112, 114, 116, and 118 are performed in order, while the components of operations 120, 122, and 124 are mixed together and then added to the electrolyte solution formed by operations 102-118. A group of operations can be performed before another group of operations. For example, operations 102 and 104 can be performed in any order, and after operations 102 and 104 are performed, operations 106, 108, 110, 112, 114, 116, 118, 120, 122, 124, 126, 128, and 130 are performed in any order. Other orders are contemplated, as one skilled in the art will appreciate. Further, one or more of operations 126, 128, and 130 are omitted in some aspects.

Figure 2:
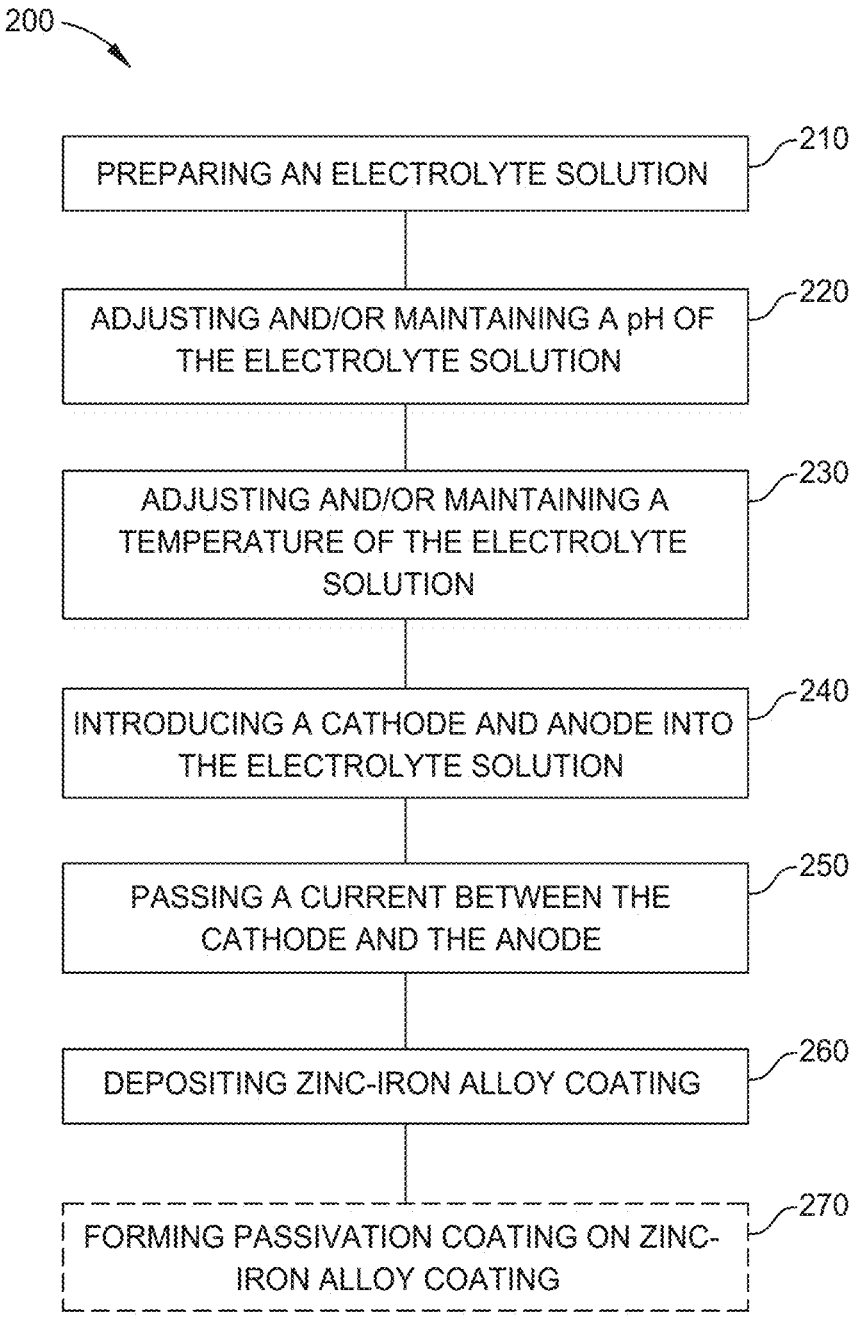
FIG. 2 depicts a flow diagram illustrating a method for forming a zinc alloy coating on a substrate by electrodeposition according to an aspect of the present disclosure.
Figure 3A:
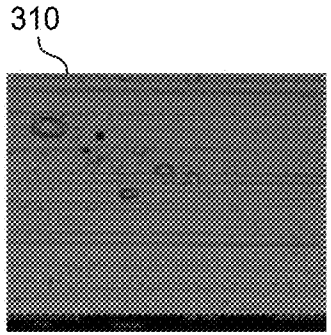
FIGS. 3A-3D depict images of cutouts of a zinc-iron alloy coated substrate formed by the process of FIG. 2 and plated at a high current density according to an aspect of the present disclosure.
Figure 3B:
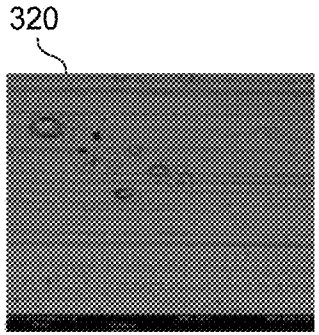
Figure 3C:
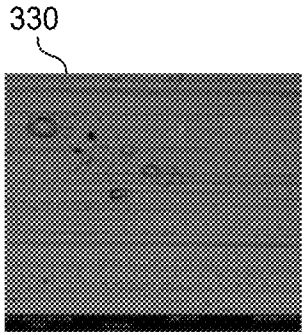
Figure 3D:
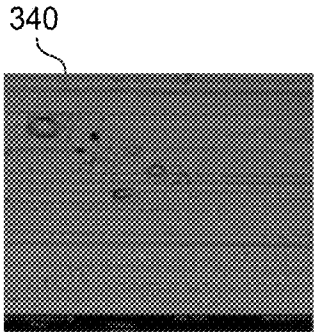
Figure 4A:
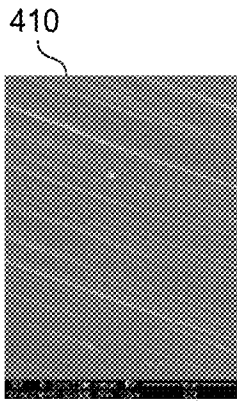
FIGS. 4A-4F depict images of cutouts of a zinc-iron alloy coated substrate formed by the process of FIG. 2 and plated at a medium current density according to an aspect of the present disclosure.
Figure 4B:
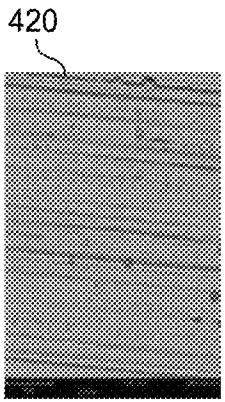
Figure 4C:
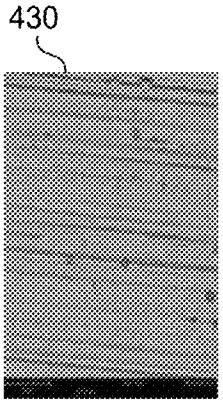
Figure 4D:
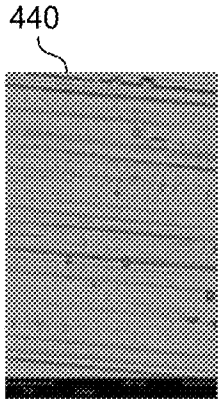
Figure 4E:
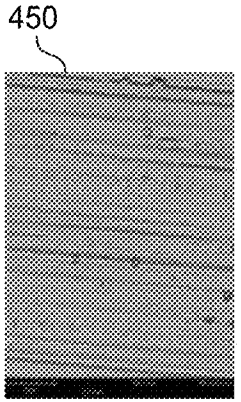
Figure 4F:
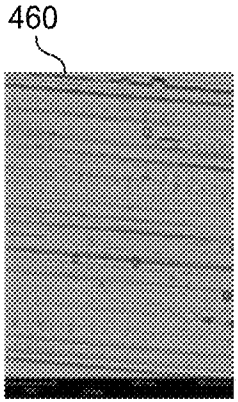
Figure 5E:
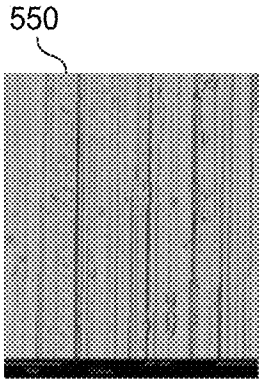
FIGS. 5A-5E depict images of cutouts of a zinc-iron alloy coated substrate formed by the process of FIG. 2 and plated at a low current density according to an aspect of the present disclosure.
Figure 5D:
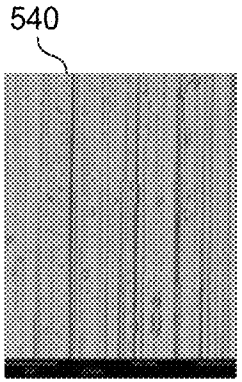
Figure 5C:
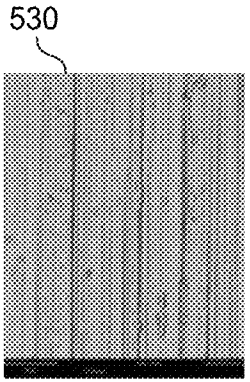
Figure 5B:
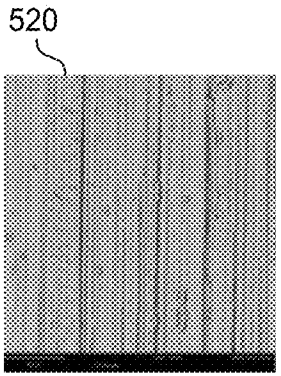
Figure 5A:
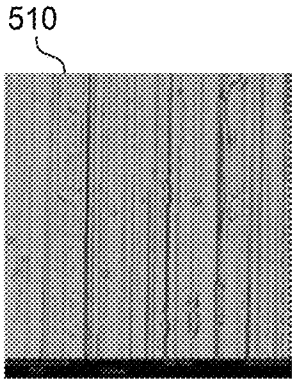

FIG. 2 is a flow diagram illustrating a method 200 for forming a zinc-iron alloy coating on a substrate by electrodeposition according to one or more aspects of the present disclosure. At operation 210, an electrolyte solution is prepared, such as by the method 100 of FIG. 1. At operation 220, the method 200 further includes adjusting and/or maintaining a pH of the electrolyte solution at a target pH or a target pH range. In at least one aspect, the target pH is a pH greater than or equal to 12, for example, a pH ranging from about 12 to about 14, such as a pH of about 14. The pH can be maintained at about 12, 12.2, 12.4, 12.6, 12.8, 13.0, 13.2, 13.4, 13.6, 13.8, 13.9 or 14.0, where any value may form an upper endpoint or a lower endpoint, as appropriate.

At operation 230, the method 200 further includes adjusting and/or maintaining a temperature of an electrolyte solution, such as the electrolyte solution formed by the method 200. The temperature is adjusted to/maintained at a target temperature of from about 20° C. to about 40° C., such as from about 20° C. to about 35° C., for example 20° C., 25° C., or 30° C., using any suitable heating or cooling apparatus. The temperature of the electrolyte solution can be adjusted before passing a current through the electrolyte solution. The temperature of the electrolyte solution can be maintained during the passing of a current through the electrolyte solution to maintain the appearance of a deposited layer. Maintaining the temperature within a desirable range promotes obtaining reproducible results in terms of appearance and alloy composition.

At operation 240, the method 200 further includes introducing a cathode and an anode into the electrolyte solution, the cathode including the substrate and at operation 250, passing a current between the cathode and the anode through the electrolyte solution to deposit a chromium alloy onto the cathodic substrate. The cathodic substrate can be, for example, a steel substrate, a ferrous alloy substrate, a copper substrate, a brass substrate, a nickel substrate, a copper-coated substrate (e.g., copper-coated steels or copper-coated ferrous alloys), or a nickel-coated substrate (e.g., nickel-coated steels or nickel-coated ferrous alloys).

In at least one aspect, the anode includes a carbonaceous electrode material. For example, the carbonaceous anode can be a graphite anode or other anode that includes carbon. Advantageously, the graphite anode or other carbonaceous anode minimizes gas evolution and formation of undesirable byproducts, as well as facilitating a desirable deposition rate (e.g., ranging from about 1 micron to about 2 microns per minute). In at least one aspect, the anode includes a zinc material. An anode containing a zinc material automatically replenishes zinc ions in the plating bath. Alternatively, a mild steel anode, a platinum anode or a platinized titanium anode can be used.

Passing a current between the cathode and the anode is performed using direct current. The direct current has a current density of from about 1 mA/cm$^2$ (A/ft$^2$) to about 120 mA/cm$^2$, from about 1 mA/cm$^2$ (A/ft$^2$) to about 110 mA/cm$^2$, from about 1 mA/cm$^2$ (A/ft$^2$) to about 100 mA/cm$^2$, such as from about 1 mA/cm$^2$ to about 55 mA/cm$^2$, for example 10 mA/cm$^2$, 20 mA/cm$^2$, 22 mA/cm$^2$, 30 mA/cm$^2$, 40 mA/cm$^2$, or 54 mA/cm$^2$ is used. The value of the current density can be adjusted depending on the separation between the cathode and anode. The current density can be about 1 mA/cm$^2$, 10 mA/cm$^2$, 15 mA/cm$^2$, 20 mA/cm$^2$, 22 mA/cm$^2$, 25 mA/cm$^2$, 30 mA/cm$^2$, 35 mA/cm$^2$, 40 mA/cm$^2$, 45 mA/cm$^2$, 50 mA/cm$^2$, or 54 mA/cm$^2$ where any value may form an upper endpoint or a lower endpoint, as appropriate, depending on the separation between the cathode and anode.

In response to passing a current between the cathode and the anode, zinc and iron deposit onto the cathodic substrate. Operation 250 is performed until a zinc-iron alloy coating layer having a desired thickness is formed on the substrate. The zinc-iron alloy has from about 1 wt. % iron to about 30 wt. % iron, such as from about 5 wt. % iron to about 25 wt. % iron, such as from about 10 wt. % iron to about 25 wt. % iron, or from about 10 wt. % iron to about 20 wt. % iron based on the total weight of the alloy. For example, the zinc-iron alloy can have a wt. % iron of about 5 wt. %, 10 wt. %, 12 wt. %, 15 wt. %, 18 wt. %, 20 wt. %, 22 wt. %, 24 wt. %, or 30 wt. %. The zinc-iron alloy has from about 75 wt. % zinc to about 95 wt. % zinc, such as from about 80 wt. % zinc to about 90 wt. % zinc, for example about 82 wt. % zinc, 84 wt. % zinc, 86 wt. % zinc, 88 wt. % zinc, or 90 wt. % zinc based on the total weight of the alloy.

In response to performing operation 250, a zinc-iron alloy coating is deposited on the substrate at operation 260. Operation 250 is performed until a zinc-iron alloy coating having a desired thickness (e.g., a thickness greater than about 5 microns) is formed on the substrate.

The zinc-iron alloy coating can be exposed to a passivation process at operation 270 to form one or more passivation/conversion coatings on the zinc-iron alloy coating. Such coatings include chrome-based or chrome-free based passivation/conversion coatings that are commercially available. Non-limiting examples of a suitable chrome-free conversion coating are commercially available from GTZ (India) Private Limited of India under the tradename CHEMIDITE such as CHEMIDITE 9-6NCP.

EXAMPLES

The following non-limiting examples are provided to further illustrate aspects described herein. However, the examples are not intended to be all-inclusive and are not intended to limit the scope of the aspects described herein.

Example 1

The components of Example 1 were mixed in a stepwise manner with the sodium hydroxide and zinc oxide mixed first followed by the addition of components 3 to 9. Components 10, 11, and 12 were mixed separately. The mixture of components 10, 11, and 12 was then added to the mixture of components 1 to 9. Components 13, 14, and 15 were then added to form the final electrolyte solution. The pH of Example 1 was about 14.

| Example 1 | | | |
|---|---|---|---|
| 1. | Zinc Oxide (ZnO) | 10 g/L | 0.12M |
| 2. | Sodium Hydroxide (NaOH) | 125 g/L | 3.1M |

-continued

| Example 1 | | | |
|---|---|---|---|
| 3. | Imidazole-epichlorohydrin condensation product | 18 g/L | — |
| 4. | Aqueous solution of quaternary amine | 18 g/L | — |
| 5. | Diethylenetriamine | 3.6 g/L | 0.035M |
| 6. | Sorbitol | 8.4 g/L | 0.046M |
| 7. | Sodium benzoate | 0.72 g/L | 0.005M |
| 8. | Triethanolamine | 36 g/L | 0.24M |
| 9. | Etidronic Acid | 2.4 g/L | 0.012M |
| 10. | Ferrous Sulfate ($FeSO_4 \cdot 7H_2O$) | 20 g/L | 0.07M |
| 11. | Sodium gluconate | 20 g/L | 0.09M |
| 12. | Lutropurg ® Q 75 | 10 g/L | — |
| 13. | Ultrabrite 617 | 20 ml/L | — |
| 14. | Ultrabrite 617B | 1 ml/L | — |
| 15. | Ultrabrite 617P | 1 ml/L | — |

The plating experiments were performed, unless otherwise stated, in a Hull Cell containing 250 mL of the electrolyte solution of Example 1. The Hull Cell allows one to observe the appearance of the deposit over a wide current density range. For example, while plating in the Hull Cell, different sections of the Hull Cell panel are at different distances from the anode, and hence experienced different current densities. The highest current density ("HCD") was on the left adjacent to the anode and the lowest current density ("LCD") was on the far right with the middle current density ("MCD") positioned in between the HCD and the LCD. The HCD was from about 54 to about 108 mA/cm$^2$ (about 50 to about 100 A/ft$^2$) The MCD was from about 22 to about 54 mA/cm$^2$ (about 20 to about 50 A/ft$^2$). The LCD was from about 1 to about 22 mA/cm$^2$ (about 1 to about 20 A/ft$^2$). The plating temperature used in these experiments was the ambient room temperature (24° C. to 30° C.) unless otherwise stated.

Small portions from the regions of HCD, MCD, and LCD were cut out and analyzed for zinc and iron content by SEM-EDS (Scanning Electron Microscopy with Energy Dispersive Spectroscopy).

FIGS. 3A-3D depict images 310, 320, 330, and 340 of cutouts from a zinc-iron alloy coated substrate formed by the process of FIG. 2 and plated at a high current density (54 to 108 mA/cm2). The results of four portions of the HCD were analyzed with SEM-EDS and the results are depicted in Table I. Image 310 depicted in FIG. 3A corresponds with the column labeled Image 1/Region 1 in Table I. Image 320 depicted in FIG. 3B corresponds with the column labeled Image 2/Spot 1 in Table I. Image 330 depicted in FIG. 3C corresponds with the column labeled Image 2/Spot 2 in Table I. Image 340 depicted in FIG. 3D corresponds with the column labeled Image 2/Spot 3 in Table I.

TABLE I

| HCD (54 to 108 mA/cm$^2$) | | | | | |
|---|---|---|---|---|---|
| | Image 1/ Region 1 | Image 2/ Spot 1 | Image 2/ Spot 2 | Image 2/ Spot 3 | Average |
| Zn % | 83.66 | 82.99 | 83.53 | 83.38 | 83.39 |
| Fe % | 16.34 | 17.01 | 16.47 | 16.62 | 16.61 |

FIGS. 4A-4F depict images 410, 420, 430, 440, 450, and 460 of cutouts of a zinc-iron alloy coated substrate formed by the process of FIG. 2 and plated at a medium current density (22 to 54 mA/cm$^2$). The results of six portions of the MCD were analyzed with SEM-EDS and the results are depicted in Table II. Image 410 depicted in FIG. 4A corresponds with the column labeled Image 1/Region 1 in Table II. Image 420 depicted in FIG. 4B corresponds with the column labeled Image 2/Spot 1 in Table II. Image 430 depicted in FIG. 4C corresponds with the column labeled Image 2/Spot 2 in Table II. Image 440 depicted in FIG. 4D corresponds with the column labeled Image 2/Spot 3 in Table II. Image 450 depicted in FIG. 4E corresponds with the column labeled Image 2/Spot 4 in Table II. Image 460 depicted in FIG. 4F corresponds with the column labeled Image 2/Spot 5 in Table II.

TABLE II

| MCD (22 to 54 mA/cm$^2$) | | | | | | | |
|---|---|---|---|---|---|---|---|
| | Image 1/ Region 1 | Image 2/ Spot 1 | Image 2/ Spot 2 | Image 2/ Spot 3 | Image 2/ Spot 4 | Image 2/ Spot 5 | Average |
| Zn % | 84.48 | 83.25 | 83.74 | 83.87 | 83.34 | 84.00 | 83.78 |
| Fe % | 15.52 | 16.75 | 16.26 | 16.13 | 16.66 | 16.00 | 16.22 |

FIGS. 5A-5E depict images 510, 520, 530, 540, and 550 of cutouts from a zinc-iron alloy coated substrate formed by the process of FIG. 2 and plated at a low current density (1 to 22 mA/cm$^2$. The results of five portions of the LCD were analyzed with SEM-EDS and the results are depicted in Table III. Image 510 depicted in FIG. 5A corresponds with the column labeled Image 1/Region 1 in Table III. Image 520 depicted in FIG. 5B corresponds with the column labeled Image 2/Spot 1 in Table III. Image 530 depicted in FIG. 5C corresponds with the column labeled Image 2/Spot 2 in Table III. Image 540 depicted in FIG. 5D corresponds with the column labeled Image 2/Spot 3 in Table III. Image 550 depicted in FIG. 5E corresponds with the column labeled Image 2/Spot 4 in Table III.

TABLE III

| LCD (1 to 22 mA/cm$^2$) | | | | | | |
|---|---|---|---|---|---|---|
| | Image 1/ Region 1 | Image 2/ Spot 1 | Image 2/ Spot 2 | Image 2/ Spot 3 | Image 2/ Spot 4 | Average |
| Zn % | 84.08 | 84.39 | 84.17 | 84.27 | 83.83 | 84.15 |
| Fe % | 15.92 | 15.61 | 15.83 | 15.73 | 16.17 | 15.85 |

The average zinc to iron ratios depicted in Table I, Table II, and Table III indicate that the zinc to iron ratio is more or less approximately 85:15 over the range of current densities. Thus, the bath of Example 1 enables deposition of substantially uniform alloy compositions over a range of current densities.

Salt Spray Testing (ASTM B117)

A conversion coating, non-chromate passivation coating CHEMIDITE 9-6NCP, was disposed on zinc-iron alloy coatings deposited using the electrolyte solution of Example 1. The zinc-iron alloy coatings were deposited to thicknesses of 8 μm, 10 μm, and 12 μm. It was discovered that the zinc-iron alloy coatings formed using the electrolyte solution of Example 1 were receptive to the conversion coatings as evidenced by corrosion protection data obtained from exposure to ASTM B117 conditions.

Figure 6:
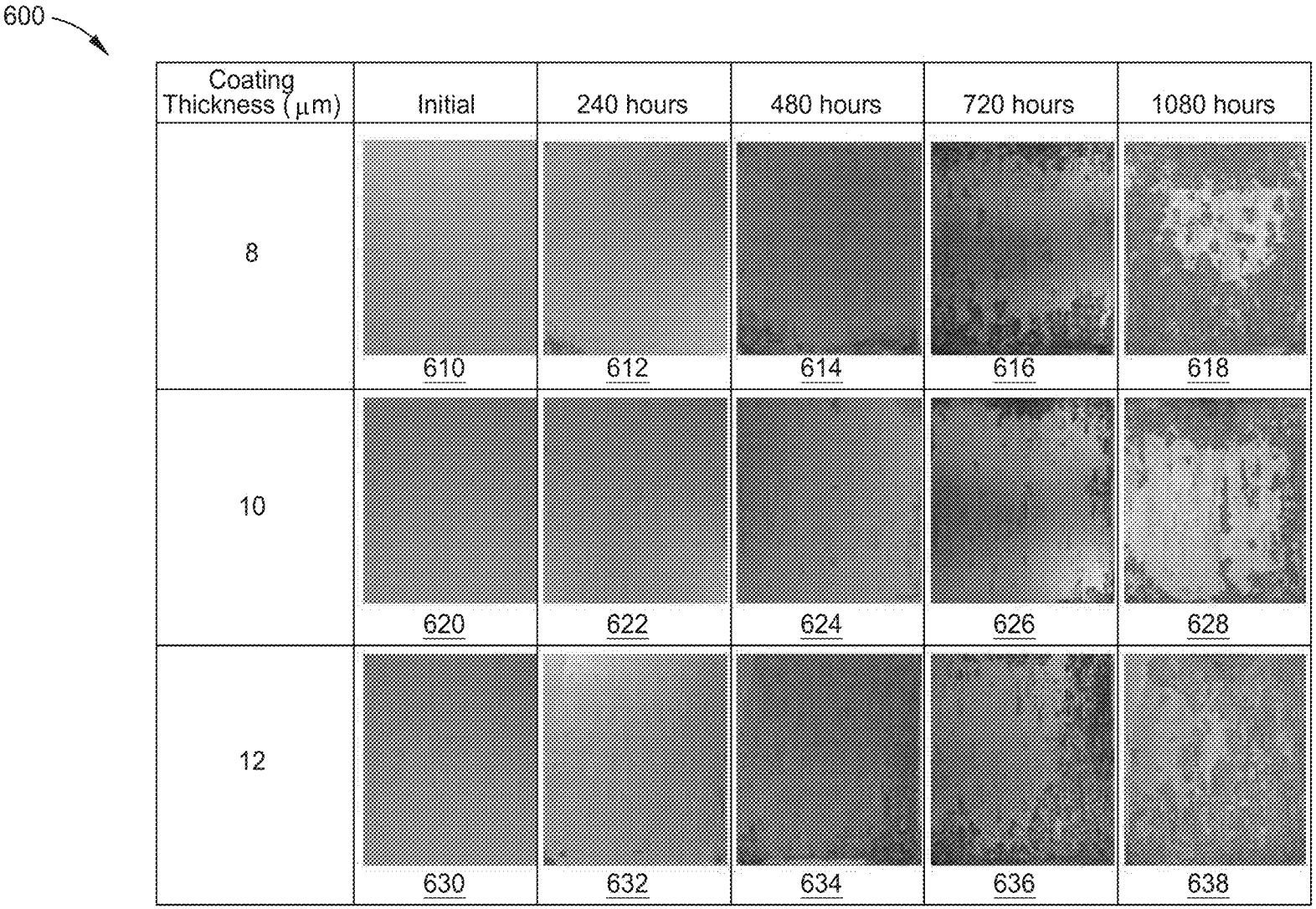
FIG. 6 depicts a graph containing images of cutouts of zinc-iron alloy coated substrates formed by the process of FIG. 2, having various thicknesses and exposed to a salt spray test for various times according to an aspect of the present disclosure.

FIG. 6 depicts a graph 600 containing images 610-638 of cutouts from zinc-iron alloy coated substrates formed by the process of FIG. 2, having various thicknesses (e.g., 8 μm, 10 μm, and 12 μm) and exposed to ASTM B117 salt spray test conditions as a function of time. For coating thicknesses of 8 μm, 10 μm, and 12 μm, zinc-iron alloy coatings prior to exposure to ASTM B117 salt spray test conditions are shown by images 610, 620 and 630 respectively as shown in graph 600. For the coating thicknesses of 8 μm, 10 μm, and 12 μm, zinc-iron alloy coatings after exposure to ASTM B117 conditions for a total of 240 hours are shown by images 612, 622 and 632 respectively as shown in graph 600. For the coating thicknesses of 8 μm, 10 μm, and 12 μm, zinc-iron alloy coatings after exposure to ASTM B117 conditions for a total of 480 hours are shown by images 614, 624 and 634 respectively as shown in graph 600. For the coating thicknesses of 8 μm, 10 μm, and 12 μm, zinc-iron alloy coatings after exposure to ASTM B117 conditions for a total of 720 hours are shown by images 616, 626 and 636 respectively as shown in graph 600. For the coating thicknesses of 8 μm, 10 μm, and 12 μm, zinc-iron alloy coatings after exposure to ASTM B117 conditions for a total of 1080 hours are shown by images 618, 628 and 638 respectively as shown in graph 600.

As depicted in graph 600, after exposure to ASTM B117 conditions, the zinc-iron alloy coatings deposited from the electrolyte solution of Example 1, and passivated with CHEMIDITE 9-6NCP indicate corrosion protection of steel substrate of 480 hours or more. As shown by images 612, 622, and 632, no blistering or white rust of the conversion coating was observed at 240 hours, indicative that the zinc-iron alloy coating is receptive to the CHEMIDITE 9-6NCP conversion coating. As shown by images 618, 628, and 638, no red rust was observed at 1080 hours, which indicates that the zinc-iron alloy coating is providing corrosion protection to steel.

A conversion coating, non-chromate passivation coating CHEMIDITE 9-6NCP, was disposed on zinc-iron alloy coatings deposited using the electrolyte solution of Example 1. The zinc-iron alloy coatings were deposited with varying weight ratios of zinc:iron (95:5, 90:10, 85:15, 80:20, and 75:25). It was discovered that the zinc-iron alloy coatings formed using the electrolyte solution of Example 1 with the varying weight ratios of zinc:iron were receptive to the conversion coatings as evidence by corrosion protection data.

Figure 7:
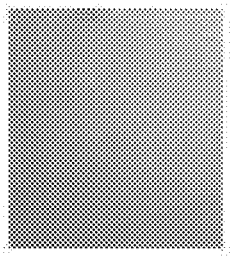
FIG. 7 depicts a graph containing various images of cutouts of a zinc-iron alloy coated substrate formed by the process of FIG. 2, having varying iron content and exposed to a salt spray test for various times according to an aspect of the present disclosure.
Figure 7:
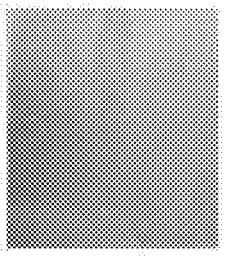
Figure 7:
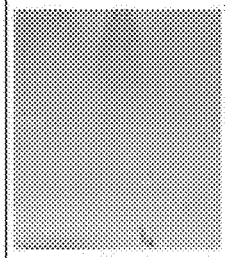
Figure 7:
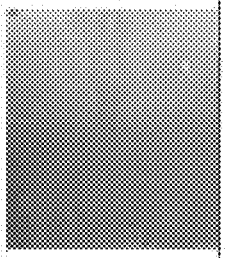
Figure 7:
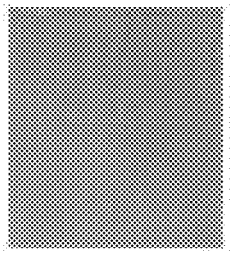
Figure 7:
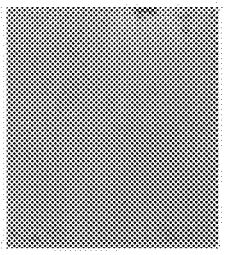
Figure 7:
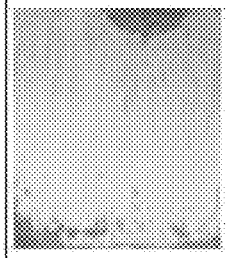
Figure 7:
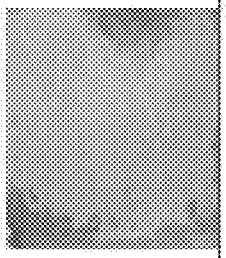
Figure 7:
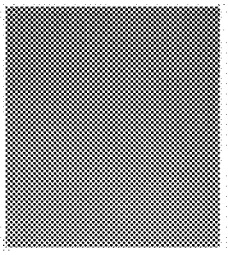
Figure 7:
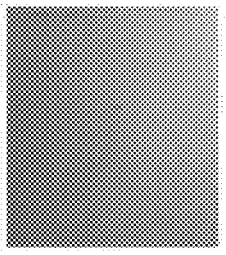
Figure 7:
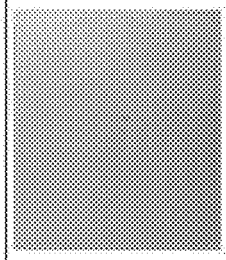
Figure 7:
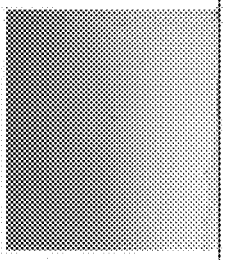
Figure 7:
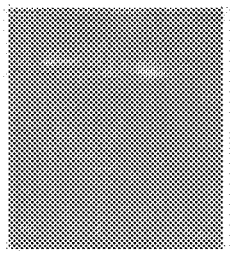
Figure 7:
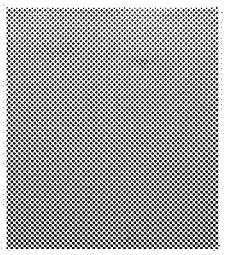
Figure 7:
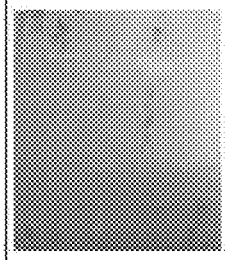
Figure 7:
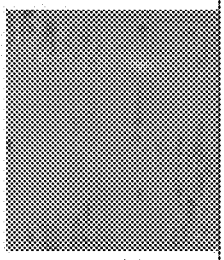
Figure 7:
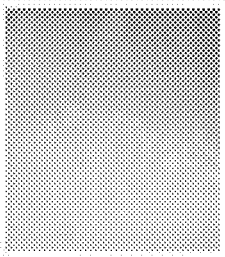
Figure 7:
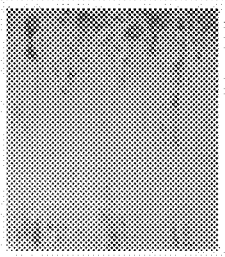
Figure 7:
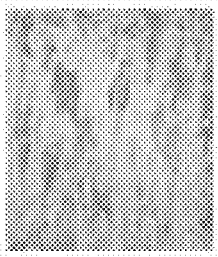
Figure 7:
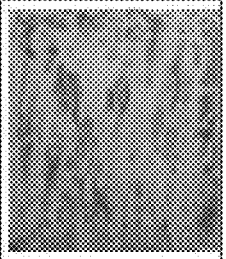

FIG. 7 depicts a graph 700 containing various images 710-756 of cutouts of a zinc-iron alloy coated substrate formed by the process of FIG. 2, having varying ratios of zinc to iron content (Zn:Fe ratio of 95:5, 90:10, 85:15, 80:20, and 75:25) and exposed to ASTM B117 salt spray test conditions as a function of various times. Images of zinc-iron alloy coatings having Zn:Fe ratios of 95:5, 90:10, 85:15, 80:20, and 75:25 prior to exposure to ASTM B117 salt spray test conditions are shown by images 710, 720, 730, 740, and 750 respectively as shown in graph 700. Images of zinc-iron alloy coatings having Zn:Fe ratios of 95:5, 90:10, 85:15, 80:20, and 75:25 after exposure to ASTM B117 conditions for a total of 72 hours are shown by images 712, 722, 732, 742, and 752 respectively as shown in graph 700. Images of zinc-iron alloy coatings having Zn:Fe ratios of 95:5, 90:10, 85:15, 80:20, and 75:25 after exposure to ASTM B117 conditions for a total of 144 hours are shown by images 714, 724, 734, 744, and 754 respectively as shown in graph 700. Images of zinc-iron alloy coatings having Zn:Fe ratios of 95:5, 90:10, 85:15, 80:20, and 75:25 after exposure to ASTM B117 conditions for a total of 216 hours are shown by images 716, 726, 736, 746, and 756 respectively as shown in graph 700.

As shown in graph 700, salt spray results performed according to ASTM B117 conditions of the zinc-iron alloy coatings having various zinc:iron ratios (95:5, 90:10, 85:15, 80:20, and 75:25), deposited from the electrolyte solution of Example 1, and passivated with CHEMIDITE 9-6NCP indicate corrosion protection of steel substrates. Visual inspection of the zinc-iron alloy coatings was performed after exposure to ASTM B117 conditions for 72 hours, 144 hours, and 216 hours. For a zinc:iron ratio of 95:5 no blistering or white rust of the conversion coating was observed after exposure to ASTM B117 conditions for 216 hours as shown by image 716, indicative that the zinc-iron alloy coating is receptive to the CHEMIDITE 9-6NCP conversion coating. No red rust was observed for 216 hours for the ratio of 95:5 as shown by image 716. For a zinc:iron ratio of 90:10 blistering and/or white rust of the conversion coating was observed after exposure to ASTM B117 conditions for 144 hours as shown by image 724. No red rust was observed after exposure to ASTM B117 conditions for 216 hours for the Ze:Fe ratio of 90:10 as shown by image 726. For a zinc:iron ratio of 85:15 no blistering and/or white rust of the conversion coating was observed after exposure to ASTM B117 conditions for 216 hours as depicted by image 736. No red rust was observed after exposure to ASTM B117 conditions for 216 hours for the Ze:Fe ratio of 85:15 as shown by image 736. For a zinc:iron ratio of 80:20 blistering and/or white rust of the conversion coating was observed after exposure to ASTM B117 conditions for 144 hours as shown by image 746. No red rust was observed after exposure to ASTM B117 conditions for 216 hours for the ratio of 80:20 as shown by image 746. For a zinc:iron ratio of 75:25 blistering and/or white rust of the conversion coating was observed after exposure to ASTM B117 conditions for 72 hours. No red rust was observed after exposure to ASTM B117 conditions for 216 hours for the ratio of 75:25.

Clause 1. A substrate comprising a zinc-iron alloy coating having a zinc content in a range of about 75 wt. % to about 95 wt. %, and an iron content in a range of about 5 wt. % to about 25 wt. %.

Clause 2. The substrate of clause 1, wherein the substrate comprises one or more of steel, copper, brass, or nickel.

Clause 3. The substrate of clause 1 or 2, wherein the coating has a thickness of from about 1 micron and about 300 microns.

Clause 4. An electrolyte solution for electroplating comprising an alkali hydroxide, a zinc salt, a condensation polymer of epichlorohydrin, a quaternary amine, an aliphatic amine, a polyhydroxy alcohol, an aromatic organic acid and/or salts thereof, an amino alcohol, a bisphosphonic acid and/or salts thereof, an iron salt, an alkali metal gluconate, and an amine-based chelating agent.

Clause 5. The electrolyte solution of clause 4, wherein the alkali hydroxide is present in an amount ranging from about 1.0 mole per liter (mol/L) to about 5 mol/L of the electrolyte solution, the zinc salt is present in an amount ranging from about 0.1 moles per liter to about 0.2 moles per liter of the electrolyte solution, the condensation polymer of epichlorohydrin is present in an amount ranging from about 10 grams/liter to about 25 grams/liter of the electrolyte solution, the quaternary amine is present in an amount ranging from about 10 grams/L to about 30 grams/L, the aliphatic amine is present in an amount ranging from about 0.03 moles per liter to about 0.05 moles per liter, the polyhydroxy alcohol is present in an amount ranging from about 0.03 moles per liter to about 0.06 moles per liter, the aromatic organic acid and/or salts thereof is present in an amount ranging from about 0.002 moles per liter to about 0.008 moles per liter, the amino alcohol is present in an amount ranging from about 0.1 moles per liter to about 0.4 moles per liter, the bisphosphonic acid and/or salts thereof is present in an amount ranging from about 0.01 moles per liter to about 0.02 moles per liter, the iron salt is present in an amount ranging from about 0.05 moles per liter to about 0.1 moles per liter, the alkali metal gluconate is present in an amount ranging from about 0.05 moles per liter to about 0.12 moles per liter, and the amine-based chelating agent is present in an amount ranging from about 7 grams/liter to about 15 grams/liter.

Clause 6. The electrolyte solution of clause 4 or 5, wherein the zinc salt is zinc oxide or a divalent zinc salt.

Clause 7. The electrolyte solution of any of clauses 4 to 6, wherein the condensation polymer of epichlorohydrin is an imidazole-epichlorohydrin condensation polymer, an amine-formaldehyde-epichlorohydrin condensation polymer, or a combination thereof.

Clause 8. The electrolyte solution of any of clauses 4 to 7, wherein the aliphatic amine is selected from ethylenediamine, diethylenetriamine, dipropylenetriamine, triethylenetetramine, tetraethylenepentamine, hexamethylenediamine, and N,N'-bis-(triaminopropyl) ethylenediamine, or a combination thereof.

Clause 9. The electrolyte solution of any of clauses 4 to 8, wherein the organic acid and/or salts thereof is selected from sodium benzoate, potassium benzoate, or a combination thereof.

Clause 10. The electrolyte solution of any of clauses 4 to 9, wherein the amino alcohol is selected from ethanolamine, diethanolamine, triethanolamine, or a combination thereof.

Clause 11. The electrolyte solution of any of clauses 4 to 10, wherein the iron salt is a divalent iron salt comprising one or more of iron (II) sulfate, iron (II) chloride, iron (II) acetate, and hydrates thereof.

Clause 12. The electrolyte solution of any of clauses 4 to 11, wherein the alkali metal gluconate is selected from sodium gluconate, potassium gluconate, or a combination thereof.

Clause 13. An electrolyte solution for electroplating comprising an alkali hydroxide in an amount ranging from about 1.0 mole per liter (mol/L) to about 5 mol/L of the electrolyte solution, a zinc salt in an amount ranging from about 0.1 moles per liter to about 0.2 moles per liter of the electrolyte solution, a condensation polymer of epichlorohydrin in an amount ranging from about 10 grams/liter to about 25 grams/liter of the electrolyte solution, a quaternary amine in an amount ranging from about 10 grams/L to about 30 grams/L; an aliphatic amine in an amount ranging from about 0.03 moles per liter to about 0.05 moles per liter, a polyhydroxy alcohol in an amount ranging from about 0.03 moles per liter to about 0.06 moles per liter, an aromatic organic acid and/or salts thereof in an amount ranging from about 0.002 moles per liter to about 0.008 moles per liter, an amino alcohol in an amount ranging from about 0.1 moles per liter to about 0.4 moles per liter, a bisphosphonic acid and/or salts thereof in an amount ranging from about 0.01 moles per liter to about 0.02 moles per liter, an iron salt in an amount ranging from about 0.05 moles per liter to about 0.1 moles per liter, an alkali metal gluconate in an amount ranging from about 0.05 moles per liter to about 0.12 moles per liter, and an amine-based chelating agent in an amount ranging from about 7 grams/liter to about 15 grams/liter.

Clause 14. The electrolyte solution of clause 13, wherein the zinc salt is zinc oxide or a divalent zinc salt.

Clause 15. The electrolyte solution of clause 13 or 14, wherein the condensation polymer of epichlorohydrin is an imidazole-epichlorohydrin condensation polymer, an amine-formaldehyde-epichlorohydrin condensation polymer, or a combination thereof.

Clause 16. The electrolyte solution of any of clauses 13 to 15, wherein the aliphatic amine is selected from ethylenediamine, diethylenetriamine, dipropylenetriamine, triethylenetetramine, tetraethylenepentamine, hexamethylenediamine, and N,N'-bis-(triaminopropyl) ethylenediamine, or a combination thereof.

Clause 17. The electrolyte solution of any of clauses 13 to 16, wherein the aromatic organic acid and/or salts thereof is selected from sodium benzoate, potassium benzoate, or a combination thereof.

Clause 18. The electrolyte solution of any of clauses 13 to 17, wherein the amino alcohol is selected from ethanolamine, diethanolamine, triethanolamine, or a combination thereof.

Clause 19. The electrolyte solution of any of clauses 13 to 18, wherein the iron salt is a divalent iron salt comprising one or more of iron (II) sulfate, iron (II) chloride, iron (II) acetate, and hydrates thereof.

Clause 20. The electrolyte solution of any of clauses 13 to 19, wherein the alkali metal gluconate is selected from sodium gluconate, potassium gluconate, or a combination thereof.

Clause 21. The electrolyte solution of any of clauses 13 to 20, wherein the pH of the electrolyte solution is about 14.

Clause 22. A method of zinc plating on a substrate using an electrolyte solution, comprising introducing a cathode and an anode into an electrolyte solution comprising an alkali hydroxide, a zinc salt, a condensation polymer of epichlorohydrin, a quaternary amine, an aliphatic amine, a polyhydroxy alcohol, an aromatic organic acid and/or salts thereof, an amino alcohol, a bisphosphonic acid of salt thereof, an iron salt, an alkali metal gluconate, and an amine-based chelating agent, and passing a current between the anode and the cathode through the electrolyte to deposit a zinc-iron alloy layer on the substrate.

Clause 23. The method of clause 22, wherein the cathode is a steel substrate, a copper substrate, a brass substrate, a nickel substrate, a copper-coated substrate, or a nickel-coated substrate.

Clause 24. The method of clause 22 or 23, wherein the anode is a zinc material, steel, or a carbonaceous electrode material.

Clause 25. The method of any of clauses 22 to 24, wherein the current has a current density in a range from about 1 $mA/cm^2$ to about 108 $mA/cm^2$ by passing direct current between the anode and the cathode.

Clause 26. The method of any of clauses 22 to 25, wherein the current density has a current density in a range from about 1 $mA/cm^2$ to about 54 $mA/cm^2$.

Clause 27. The method of any of clauses 22 to 26, wherein the electrolyte solution is maintained at a temperature in a range from about 20 degrees Celsius and about 30 degrees Celsius.

Clause 28. The method of any of clauses 22 to 27, wherein the pH is about 14.

Clause 29. The method of any of clauses 22 to 28, wherein the zinc salt is zinc oxide or a divalent zinc salt.

Clause 30. The method of any of clauses 22 to 29, wherein the condensation polymer of epichlorohydrin is an imidazole-epichlorohydrin condensation polymer, an amine-formaldehyde-epichlorohydrin condensation polymer, or a combination thereof.

Clause 31. The method of any of clauses 22 to 30, wherein the aliphatic amine is selected from ethylenediamine, diethylenetriamine, dipropylenetriamine, triethylenetetramine, tetraethylenepentamine, hexamethylenediamine, and N,N'-bis-(triaminopropyl) ethylenediamine, or a combination thereof.

Clause 32. The method of any of clauses 22 to 31, wherein the aromatic organic acid and/or salts thereof is selected from sodium benzoate, potassium benzoate, or a combination thereof.

Clause 33. The method of any of clauses 22 to 32, wherein the amino alcohol is selected from ethanolamine, diethanolamine, triethanolamine, or a combination thereof.

Clause 34. The method of any of clauses 22 to 33, wherein the iron salt is a divalent iron salt comprising one or more of iron (II) sulfate, iron (II) chloride, iron (II) acetate, and hydrates thereof.

Clause 35. The method of any of clauses 22 to 34, wherein the alkali metal gluconate is selected from sodium gluconate, potassium gluconate, or a combination thereof.

Clause 36. A method of zinc plating on a substrate using an electrolyte solution, comprising dissolving in an aqueous medium a zinc salt in an amount ranging from about 0.1 moles per liter to about 0.2 moles per liter of the electrolyte solution, dissolving a condensation polymer of epichlorohydrin in an amount ranging from about 10 grams/liter to about 25 grams/liter of the electrolyte solution, dissolving a quaternary amine in an amount ranging from about 10 grams/L to about 30 grams/L, dissolving an aliphatic amine in an amount ranging from about 0.03 moles per liter to about 0.05 moles per liter, dissolving a polyhydroxy alcohol in an amount ranging from about 0.03 moles per liter to about 0.06 moles per liter, dissolving an aromatic organic acid and/or salt thereof in an amount ranging from about 0.002 moles per liter to about 0.008 moles per liter, dissolving an amino alcohol in an amount ranging from about 0.1 moles per liter to about 0.4 moles per liter, dissolving a bisphosphonic acid and/or salts thereof in an amount ranging from about 0.01 moles per liter to about 0.02 moles per liter, dissolving an iron salt in an amount ranging from about 0.05 moles per liter to about 0.1 moles per liter, dissolving an alkali metal gluconate in an amount ranging from about 0.05 moles per liter to about 0.12 moles per liter, and dissolving an amine-based chelating agent in an amount ranging from about 7 grams/liter to about 15 grams/liter, and passing a current between a cathode and an anode through the electrolyte solution to deposit a zinc-iron alloy on a substrate.

Clause 37. The method of clause 36, wherein the aqueous medium comprises sodium hydroxide, potassium hydroxide, or a combination thereof.

Clause 38. The method of clause 36 or 37, wherein the cathode is a steel substrate, a copper substrate, a brass substrate, a nickel substrate, a copper-coated substrate, or a nickel-coated substrate.

Clause 39. The method of any of clauses 36 to 38, wherein the anode is a zinc material, steel, or a carbonaceous electrode material.

Clause 40. The method of any of clauses 36 to 39, wherein the current has a current density in a range from about 1 $mA/cm^2$ to about 108 $mA/cm^2$ by passing direct current between the anode and the cathode.

Clause 41. The method of any of clauses 36 to 40, wherein the current density has a current density in a range from about 1 $mA/cm^2$ to about 54 $mA/cm^2$.

Clause 42. The method of any of clauses 36 to 41, wherein the electrolyte solution is maintained at a temperature in a range from about 20 degrees Celsius and about 35 degrees Celsius.

Clause 43. The method of any of clauses 36 to 42, wherein the pH is about 14.

Clause 44. The method of any of clauses 36 to 43, wherein the zinc salt is zinc oxide or a divalent zinc salt.

Clause 45. The method of any of clauses 36 to 44, wherein the condensation polymer of epichlorohydrin is an imidazole-epichlorohydrin condensation polymer, an amine-formaldehyde-epichlorohydrin condensation polymer, or a combination thereof.

Clause 46. The method of any of clauses 36 to 45, wherein the aliphatic amine is selected from ethylenediamine, diethylenetriamine, dipropylenetriamine, triethylenetetramine, tetraethylenepentamine, hexamethylenediamine, and N,N'-bis-(triaminopropyl) ethylenediamine, or a combination thereof.

Clause 47. The method of any of clauses 36 to 46, wherein the aromatic organic acid and/or salts thereof is selected from sodium benzoate, potassium benzoate, or a combination thereof.

Clause 48. The method of any of clauses 36 to 47, wherein the amino alcohol is selected from ethanolamine, diethanolamine, triethanolamine, or a combination thereof.

Clause 49. The method of any of clauses 36 to 48, wherein the iron salt is a divalent iron salt comprising one or more of iron (II) sulfate, iron (II) chloride, iron (II) acetate, and hydrates thereof.

Clause 50. The method of any of clauses 36 to 49, wherein the alkali metal gluconate is selected from sodium gluconate, potassium gluconate, or a combination thereof.

Overall, the present disclosure provides improved electrolyte solutions for electrodeposition of zinc-iron alloys, methods of forming zinc-iron alloys, and methods of electrodepositing zinc-iron alloys.

It should be noted that the terms "first" and "second," and similar terms preceding an element name, e.g., first complexing agent, second complexing agent, etc. are used for identification purposes to distinguish between similar or related elements, results, or concepts and are not intended to necessarily imply order unless specifically stated. Indeed, it should be appreciated, for example, that the terms "first" and "second" can be interchangeable such that items to which they refer incorporate features of the other where appropriate.

The descriptions of the various aspects of the present disclosure have been presented for purposes of illustration, but are not intended to be exhaustive or limited to the aspects disclosed. Many modifications and variations will be apparent to those of ordinary skill in the art without departing from the scope and spirit of the described aspects. The terminology used herein was chosen to best explain the principles of the aspects, the practical application or technical improvement over technologies found in the marketplace, or to enable others of ordinary skill in the art to understand the aspects disclosed herein. While the foregoing is directed to aspects of the present disclosure, other and further aspects of the present disclosure can be devised without departing from the basic scope thereof.

What is claimed is:

1. A method of zinc plating on a cathodic substrate using an electrolyte solution, comprising:

forming a first solution comprising an iron salt, an alkali metal gluconate, and a poly(hydroxyalkyl)alkylenediamine;

forming an electrolyte solution by introducing with the first solution an alkali hydroxide, a zinc salt, a condensation polymer of epichlorohydrin that is an amine-formaldehyde-epichlorohydrin condensation polymer, a quaternary amine, an aliphatic amine, a polyhydroxy alcohol, an aromatic organic acid and/or salts thereof, an amino alcohol, and a bisphosphonic acid and/or salts thereof;

introducing the cathodic substrate and an anode into the electrolyte solution wherein the electrolyte solution is nickel-free; and passing a current between the anode and the cathodic substrate through the electrolyte solution to deposit a zinc-iron alloy layer on the cathodic substrate, the zinc-iron alloy having an iron content of about 5 wt % to about 25 wt % based on total weight of the alloy.

2. The method of claim 1, wherein the cathodic substrate is a steel substrate, a copper substrate, a brass substrate, a nickel substrate, a copper-coated substrate, or a nickel-coated substrate.

3. The method of claim 1, wherein the anode is a zinc material, steel, or a carbonaceous electrode material.

4. The method of claim 1, wherein the current has a current density in a range from about 1 $mA/cm^2$ to about 108 $mA/cm^2$ by passing direct current between the anode and the cathodic substrate.

5. The method of claim 1, wherein the current has a current density in a range from about 1 $mA/cm^2$ to about 54 $mA/cm^2$.

6. The method of claim 1, wherein the electrolyte solution is maintained at a temperature in a range from about 20 degrees Celsius and about 30 degrees Celsius.

7. The method of claim 1, wherein the electrolyte solution has a pH of about 14.

8. The method of claim 1, wherein the poly(hydroxyalkyl) alkylenediamine is selected from the group consisting of N-2(-hydroxyethyl)-N,N',N'-triethylethylenediamine, N,N'-di(2-hydroxyethyl)-N,N'-diethylethylenediamine, N,N,N',N'-tetrakis(2-hydroxyethyl)propylenediamine, N,N,N',N'-tetrakis(2-hydroxypropyl)ethylenediamine, and combinations thereof.

9. The method of claim 1, wherein the iron salt is ferrous sulfate, the alkali metal gluconate is sodium gluconate, and the poly(hydroxyalkyl)alkylenediamine is N,N,N',N'-tetrakis(2-hydroxypropyl)ethylenediamine.

10. The method of claim 1, wherein the anode is a graphite anode.

11. The method of claim 1, wherein the iron salt is a divalent iron salt selected from the group consisting of iron (II) sulfate, iron (II) chloride, iron (II) acetate, hydrates thereof, and combinations thereof.

12. The method of claim 1, wherein the alkali metal gluconate is selected from the group consisting of sodium gluconate, potassium gluconate, and combinations thereof.

13. The method of claim 1, wherein:

the alkali metal gluconate is sodium gluconate, the poly(hydroxyalkyl)alkylenediamine is N,N,N',N'-tetrakis(2-hydroxypropyl)ethylenediamine, and the iron salt is a divalent iron salt selected from the group consisting of iron (II) sulfate, iron (II) chloride, iron (II) acetate, hydrates thereof, and combinations thereof.

14. The method of claim 13, wherein a concentration of the iron salt in the electrolyte solution is about 0.05 mol/L to about 0.1 mol/L.

15. The method of claim 14, wherein the electrolyte solution has a pH of about 14.

16. The method of claim 14, wherein the iron salt is iron (II) sulfate.

17. The method of claim 14, wherein the concentration of the iron salt in the electrolyte solution is about 0.07 mol/L.

18. The method of claim 1, wherein a concentration of the iron salt in the electrolyte solution is about 0.05 mol/L to about 0.1 mol/L.

19. The method of claim 1, wherein:

the aromatic organic acid and/or salts thereof is selected from the group consisting of sodium benzoate, potassium benzoate, and combinations thereof.

20. The method of claim 19, wherein:

the iron salt is a divalent iron salt selected from the group consisting of iron (II) sulfate, iron (II) chloride, iron (II) acetate, hydrates thereof, and combinations thereof, and the alkali metal gluconate is selected from the group consisting of sodium gluconate, potassium gluconate, and combinations thereof.

21. The method of claim 1, wherein the deposited zinc-iron alloy comprises a thickness of about 1 micron to about 30 microns.

22. The method of claim 1, wherein the deposited zinc-iron alloy comprises a thickness of about 8 microns to about 12 microns.

23. The method of claim 1, wherein the electrolyte solution comprises a pH of about 12 to about 14.

24. The method of claim 1, wherein the zinc-iron alloy is deposited onto the cathodic substrate at a deposition rate of about 1 micron per minute to about 2 microns per minute.

25. The method of claim 1, wherein the amino alcohol of the electrolyte solution comprises ethanolamine, diethanolamine, triethanolamine, or a combination thereof.

26. The method of claim 1, wherein the aliphatic amine of the electrolyte solution comprises ethylenediamine, diethylenetriamine, dipropylaminetriamine, triethylentetramine, tetraethylenepentamine, hexamethylenediamine, N,N'-bis-(triaminopropyl) ethylene diamine, or a combination thereof.

* * * * *